US007156702B2

(12) United States Patent
Sakamoto

(10) Patent No.: US 7,156,702 B2
(45) Date of Patent: Jan. 2, 2007

(54) CONNECTOR

(75) Inventor: Nobuyuki Sakamoto, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/302,233

(22) Filed: Dec. 14, 2005

(65) Prior Publication Data

US 2006/0141871 A1 Jun. 29, 2006

(30) Foreign Application Priority Data

Dec. 28, 2004 (JP) ..... P2004-381875

(51) Int. Cl.
*H01R 13/503* (2006.01)

(52) U.S. Cl. ..... 439/701

(58) Field of Classification Search ..... 439/701, 439/595, 752, 747, 140, 135
See application file for complete search history.

(56) References Cited

U.S. PATENT DOCUMENTS 6,244,901 B1 * 6/2001 Fujii et al. ..... 439/596
6,893,292 B1 * 5/2005 Yamamoto et al. ..... 439/595
2004/0057691 A1 * 3/2004 Doss et al. ..... 385/134
2004/0168317 A1 * 9/2004 Aluffo ..... 29/863

FOREIGN PATENT DOCUMENTS

JP 2518968 Y2 9/1996
JP 10-069936 A 3/1998

* cited by examiner

*Primary Examiner*—J. F. Duverne
(74) *Attorney, Agent, or Firm*—Sughrue Mion, PLLC

(57) ABSTRACT

A connector includes a first housing, a second housing arranged on an upper face of the first housing, and a cover engaged to at least one of the first housing and the second housing so as to cover the upper face of the first housing and an upper face of the second housing. The first housing, the second housing and the cover are engaged to each other at a first engagement state and a second engagement state. A plurality of press contact terminals with wires are inserted into the first housing and the second housing respectively in the first engagement state. Spaces for allowing the insertion of crimp terminals into the first housing and the second housing respectively are formed between the first housing and the second housing and between the cover and the second housing in the first engagement state. The second housing and the cover are advanced into the spaces in the second engagement state.

7 Claims, 26 Drawing Sheets

CONNECTOR

BACKGROUND OF THE INVENTION

The present invention relates to a connector integrated through layering of connector housings and a cover with both a pressure contact terminal and a crimp terminal inserted into each connector housing.

A united connector is known in the related art (for example, refer to JP-A-10-69936, pages 3–4 and FIGS. 10, 11; and Japanese Utility Model No. 2,518,968, pages 2–3 and FIG. 1). FIG. 27 is an exploded perspective view of a united connector disclosed in JP-A-10-69936. FIG. 28 is a perspective view showing the united state of the united connector shown in FIG. 27.

As shown in FIGS. 27 and 28, a united connector 100 has terminals 103 assembled into an upper connector housing 101 and a lower connector housing 102 and electric wires 104 connected to the terminals 103 via pressure contact, the connector housings layered and integrated with an upper cover 105.

That is, the upper and lower connector housings 101, 102 are layered while having an engagement hook provided on the bottom surface of the upper connector housing 101 inserted and locked to a lance hole 106 of the lower connector housing 102, having an outward hook 107 and an inward hook 106 arranged on the connector housings 101, 102 engaged to each other, and having an outward hook 110 arranged on the upper cover 105 engaged to the inward hook 108 arranged on the upper connector housing 101, thereby integrated into a united connector.

FIG. 29 is an exploded perspective view showing a pressure contact terminal as a united connector disclosed in Japanese Utility Model No. 2,518,968.

As shown in FIG. 29, the pressure contact terminal 200 as a united connector includes upper, middle and lower housings 201, 202, 203 and a pair of covers 204. These components are united by causing engaging recessed parts 205 to be engaged with engaging protruding parts 206 arranged on the outer wall surface of each housing 201, 202, 203.

The upper housing 201 provided with a base plate 207 in its center. The base plate 207 is provided with a locking arm in cantilever form. Terminal receiving chambers 209 at both ends of the locking arm 208 each has its rear open surface covered by each cover 204. Each cover 204 has an engagement recessed part 206 locked to the front supper surface of the terminal receiving chamber 209 and has an engaging part 210 engaged with a claw 21 arranged on the upper housing 201 so that the cover is fixed to the upper housing 201.

The problem is that, for the connector 100 according to the related art shown in FIGS. 27 and 28 disclosed in JP-A-10-69936, it is impossible to insert the terminal 103 once the connector housings 101, 102 have been united with the upper cover 105. This impairs the workability including terminal insertion in the post-processing.

That is, during terminal insertion in the post-processing, the connector housings 101, 102 must be disengaged from the upper cover 15 to return the connector assembly in the state shown in FIG. 27, and then the components must be united after terminal insertion, which results in increased man-hours.

During terminal insertion in the post-processing, the united connector 100 placed in the state shown in FIG. 27 has terminals 103 assembled to the connector housings 101, 102 as well as brings electric wires 104 in pressured contact with the terminals 103. Cabling in this state requires protecting components such as a rod clamp to protect a portion above the pressure contact part of the electric wire 104. This results in a larger number of components. In a second engagement state of the connector housings 101, 102 and the upper cover 105, a load caused by an external force is applied to the connection part of the electric wire 104, which results in poor electrical contact.

Moreover, the connector housings 101, 102 and the upper cover 105 of the united connector 100 can be kept only in the non-united state shown in FIG. 27 or united state shown in FIG. 28. Thus, when the connector components are stored before it is united, there are inevitably a larger number of components.

For pressure contact connector shown in FIG. 29 disclosed in Japanese Utility Model No. 2,518,968, a pair of covers 204 is fixed to the upper housing 201 so as to cover the terminal receiving chambers 209 at both ends of the locking arm 208. Two cover components 204 are required to sandwich the locking arm 208.

That is, the displacement amount that accompanies union of connectors differs between the locking arm 208 and the terminal receiving chamber 209 of the connector housings 201, 202, 203. In order to reduce the profile of the center of the pressure contact connector 200, separate cover members 204 must be used for the locking arm 208 and each terminal receiving chamber 209. This results in a larger number of components and more man-hours of assembly.

SUMMARY OF THE INVENTION

The invention has been accomplished in view of the above circumstances. An object of the invention is to provide a connector capable of inserting a crimp terminal after the first engagement of a connector housing and a cover thus improving the workability of terminal insertion in the post-processing as well as securing a sufficient holding force of a pressure contact terminal, a crimp terminal and an electric wire, and a method for assembling the united connector.

1) The invention provides a connector comprising:

a first housing;

a second housing arranged on an upper face of the first housing; and a cover engaged to at least one of the first housing and the second housing so as to cover the upper face of the first housing and an upper face of the second housing, wherein the first housing, the second housing and the cover are engaged to each other at a first engagement state and a second engagement state;

wherein a plurality of press contact terminals with wires are inserted into the first housing and the second housing respectively in the first engagement state;

wherein spaces for allowing the insertion of crimp terminals into the first housing and the second housing respectively are formed between the first housing and the second housing and between the cover and the second housing in the first engagement state; and wherein the second housing and the cover are advanced into the spaces in the second engagement state.

With the connector, the spaces for inserting a crimp terminal is formed between the first and second housings and between the cover and the second housing in the first engagement state in which a pressure contact terminal and a crimp terminal are inserted into the first and the second housings and an electric wire is brought into pressure contact with the inserted pressure contact terminal and the first and second housings and the cover are integrated. This allows a crimp terminal to be inserted after the connector housings and the cover are engaged to each other in the first engagement. As a result, a connector provides excellent in the workability of terminal insertion in the post-processing.

The second housing and the cover are advanced into the spaces while being pressed from outside after the crimp terminal is inserted into the spaces for inserting the crimp terminal, thereby locking each housing with the cover to enter the second engagement state. This provides a connector capable of reliably holding a crimp terminal, a pressure contact terminal and an electric wire.

2) The invention provides the connector according to 1), wherein a first cover protrusion for first engagement and a second cover protrusion for second engagement are provided on a side end portion of the cover;

wherein a first housing protrusion for the second engagement is provided on a side end portion of the second housing;

wherein a first housing recessed part and a second housing recessed part are provided on a side end portion of the first housing;

wherein the first housing recessed part is engaged to the first cover protrusion in the first engagement state;

wherein the first housing recessed part is engaged to the second cover protrusion in the second engagement state; and wherein the second housing recessed part is engaged to the first cover protrusion and the first housing protrusion in the second engagement state.

With the connector, the first cover protrusion of the cover is locked to the first lower housing recessed part of the first housing in the first engagement state. The second cover protrusion is locked to the first lower housing recessed part of the first housing and the first cover protrusion of the cover and the upper housing protrusion of the second housing are locked to the second lower housing recessed part of the first housing. This readily and reliably holds each housing and cover in the first or second engagement state. A situation is avoided where only part of housing or cover is in the second engagement state and the locked part is deformed in an intermediate state between the first engagement state and second engagement state. This provides a connector that allows easy visual check of the engagement state.

3) The invention provides the connector according to 1) or 2), wherein the cover includes a central part, cover parts arranged on both sides of the central part, and flexible displacement parts arranged between the central part and each of the cover parts; and wherein the flexible displacement parts absorbs the difference of a displacement amount between the central part and the cover parts by a flexibility of the flexible displacement parts when the connector displaces from the first engagement state to the second engagement state.

With the connector, the flexible displacement part of the cover absorbs by deformation the difference in the displacement amount between the central part and each cover in displacement from the first engagement state to the second engagement state. This provides the same clearance dimension between the cover and the connector housing and elsewhere, thereby preventing the clearance dimension at the center part from becoming greater than elsewhere. This provides a connector that reliably holds a terminal in the terminal insertion work or first engagement.

4) The invention provides the connector according to any one of 1) through 3), wherein a first cover protruding part is provided on a bottom face of the cover, in a position corresponding to a rear of a caulking part of the crimp terminal or a rear of a pressure contact blade of the pressure contact terminal;

wherein a first housing protruding part is provided on a bottom face of the second housing, in a position corresponding to the rear of the caulking part of the crimp terminal or the rear of the pressure contact blade of the pressure contact terminal; and wherein the cover and the second housing are displaced with respect to the first housing when the connector displaces from the first engagement state to the second engagement state so that the first cover protruding part and the first housing protruding part press wires connected to the crimp terminal and the press contact terminal respectively.

With the connector, the second cover protruding part and the first housing protruding part press an electric wire connected to the crimp terminal or pressure contact terminal and compresses the electric wire in accordance with displacement that accompanies second engagement. This provides a connector excellent in holding each terminal, an electric wire and a connector housing in the second engagement state.

5) The invention provides the connector according to any one of 1) through 4), wherein a second cover protruding part is provided on a bottom face of the cover, in a position corresponding to a rear of a connecting part of the pressure contact terminal;

wherein a second housing protruding part is provided on a bottom face of the second housing, in a position corresponding to a rear of a pressure contact blade of the pressure contact terminal; and wherein the second cover protruding part and the second housing protruding part press wires at the rear of the pressure contact blade of the press contact terminal in the first engagement state.

With the connector, the second cover protruding part and the second upper housing protruding part press an electric wire behind the pressure contact blade of the pressure contact terminal to bend the electric wire in first engagement. This prevents possible backward drop-off of a terminal or an electric wire and reduces a load on the connection part of the pressure contact terminal. 6) The invention provides the connector according to any one of 1) through 5), wherein a third cover protruding part is provided on the cover, in a position corresponding to rear of the connection part of the crimp terminal or pressure contact terminal inserted into the second housing; and wherein the third housing protruding part is provided on the second housing, in a position corresponding to rear of the connection part of the crimp terminal or pressure contact terminal inserted into the first housing.

With the connector, the third cover protruding part and the third housing protruding part are advanced into the space at behind the connection part of the crimp terminal or pressure contact terminal in accordance with the displacement of the cover and the upper connector housing that accompanies second engagement. This provides a connector that can reliably hold a pressure contact terminal or a crimp terminal.

7) A method for assembling a connector according to the invention is characterized by placing each connector housing and cover in the first engagement state with a plurality of spacers arranged on a space jig inserted, as a group, from the front of a connector housing, in a space for inserting a crimp terminal formed between connector housings and between a connector housing and a cover, during first engagement of each connector housing and cover.

With the method for assembling a connector, each connector housing and cover are brought in the first engagement state with a plurality of spacers arranged on a space jig inserted, as a group, from the front of a connector housing, in a space for inserting a crimp terminal. A space for inserting a crimp terminal is readily and reliably held during first engagement of each connector housing and cover. This provides a connector that is excellent in the workability of first engagement of each connector housing and cover.

A method of assembling a connector, comprising of:

providing a first housing, a second housing and a cover;

arranging the second housing on an upper face of the first housing;

engaging the first housing, the second housing and the cover to each other so that the cover covers the upper face of the first housing and an upper face of the second housing in a first engagement state;

inserting a plurality of crimp terminals into the first housing and the second housing respectively in the first engagement state; and displacing the cover and the second housing with respect to the first housing for displacing from the first engagement state to the second engagement state, wherein spaces for allowing the insertion of crimp terminals into the first housing and the second housing respectively are formed between the first housing and the second housing and between the cover and the second housing in the first engagement state; and wherein the second housing and the cover are advanced into the spaces in the second engagement state.

With the connector according to the invention, it is possible to insert a crimp terminal after first engagement of a connector housing and a cover, thereby improving the workability of terminal insertion in the post-processing as well as securing a sufficient holding force of a pressure contact terminal, a crimp terminal and an electric wire.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Embodiments of a united connector according to the invention will be described referring to FIGS. 1 through 26.

Figure 1:
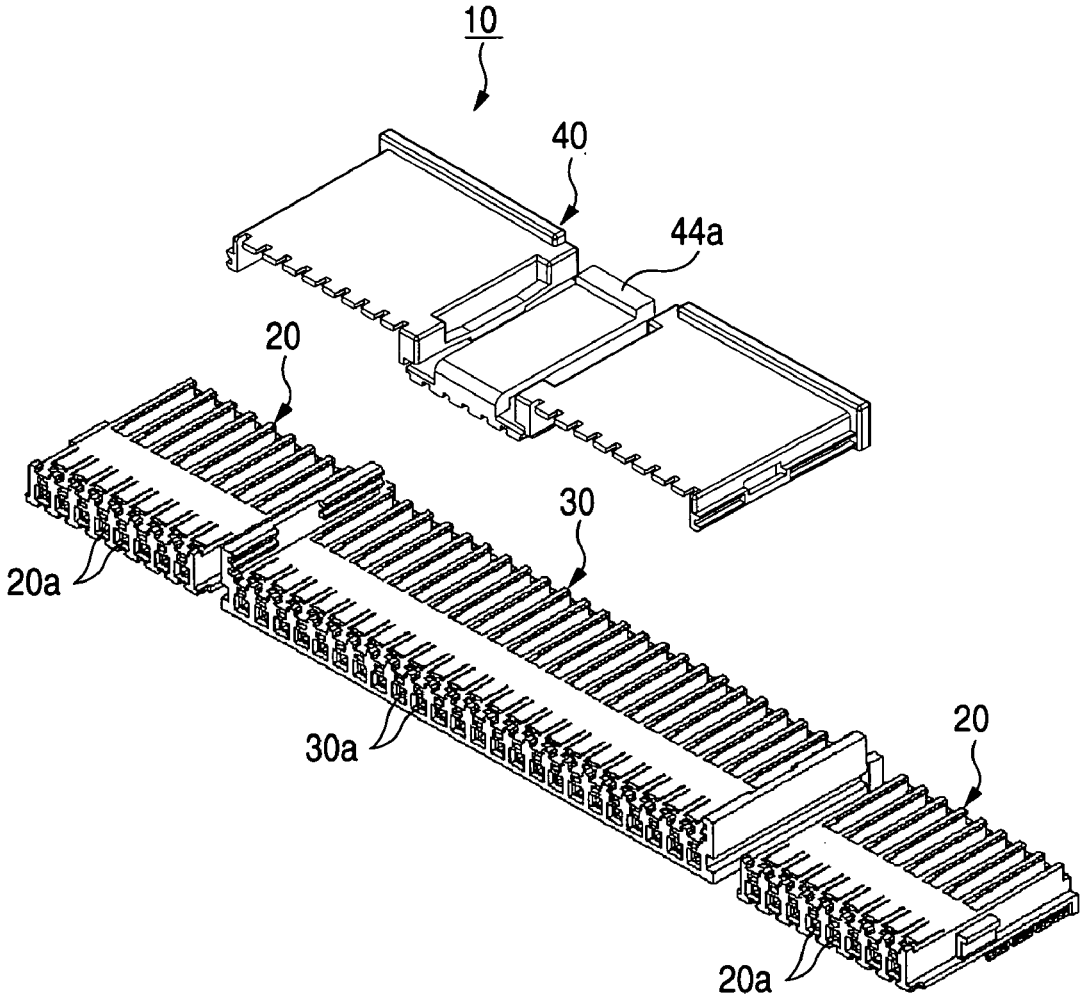
FIG. 1 is an exploded perspective view showing the state before union of a united connector as an embodiment of the invention.
Figure 2:
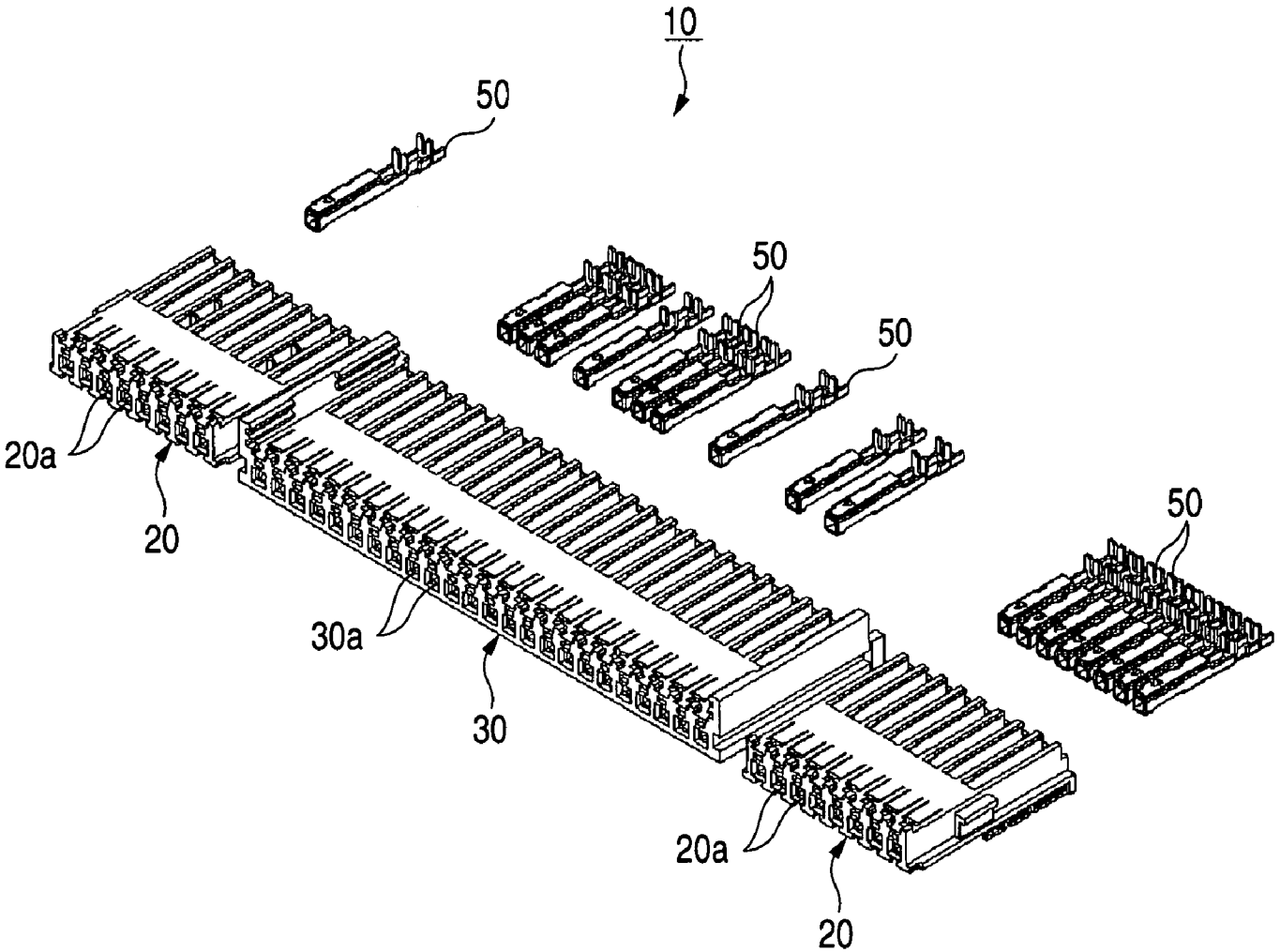
FIG. 2 is an exploded perspective view showing the state before a pressure contact terminal is inserted into the cavity of the united connector shown in FIG. 1.
Figure 3:
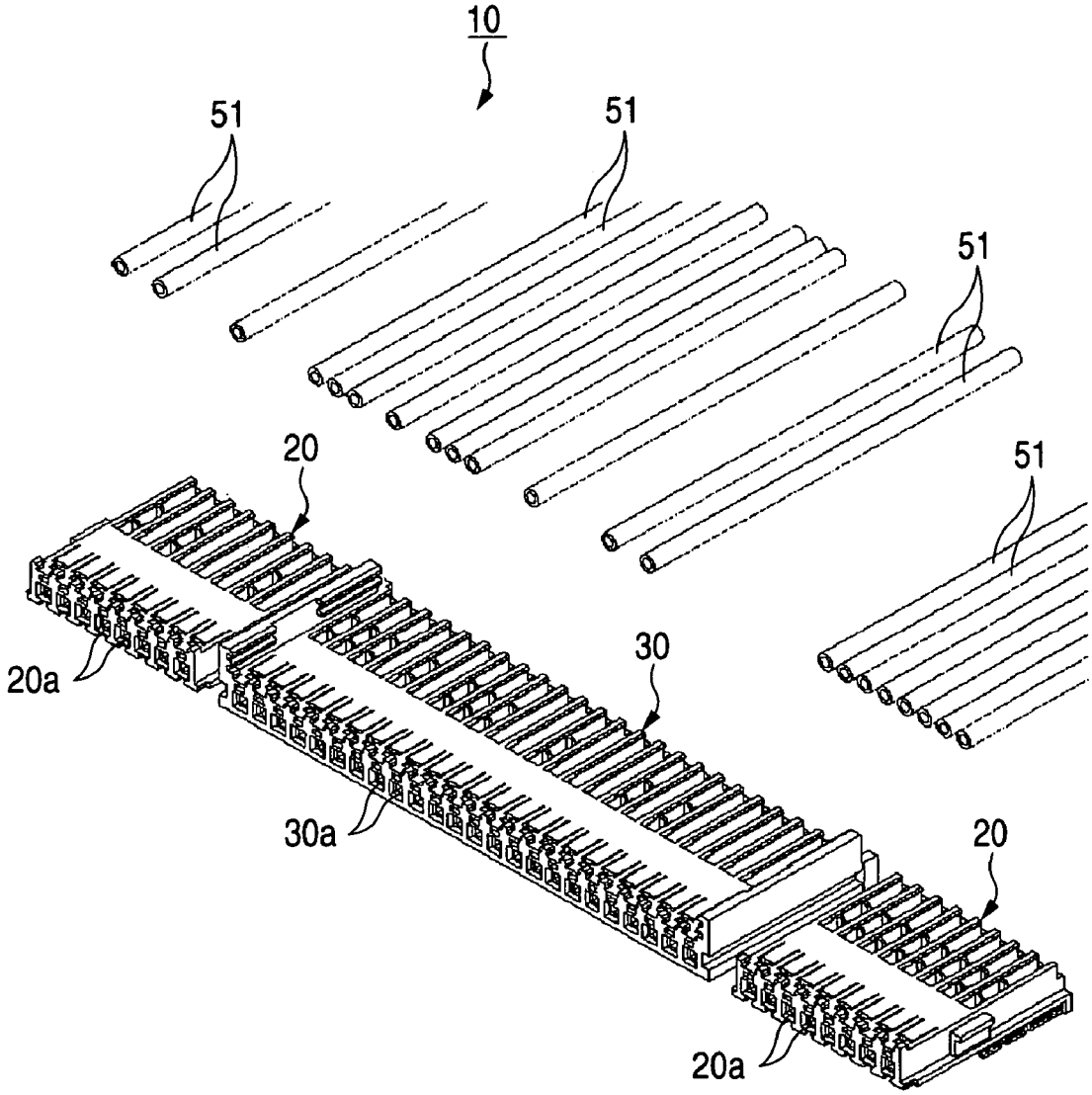
FIG. 3 is a perspective view showing the state before a pressure contact terminal inserted into the cavity of the united connector shown in FIG. 1 is brought into pressure contact with an electric wire.
Figure 4:
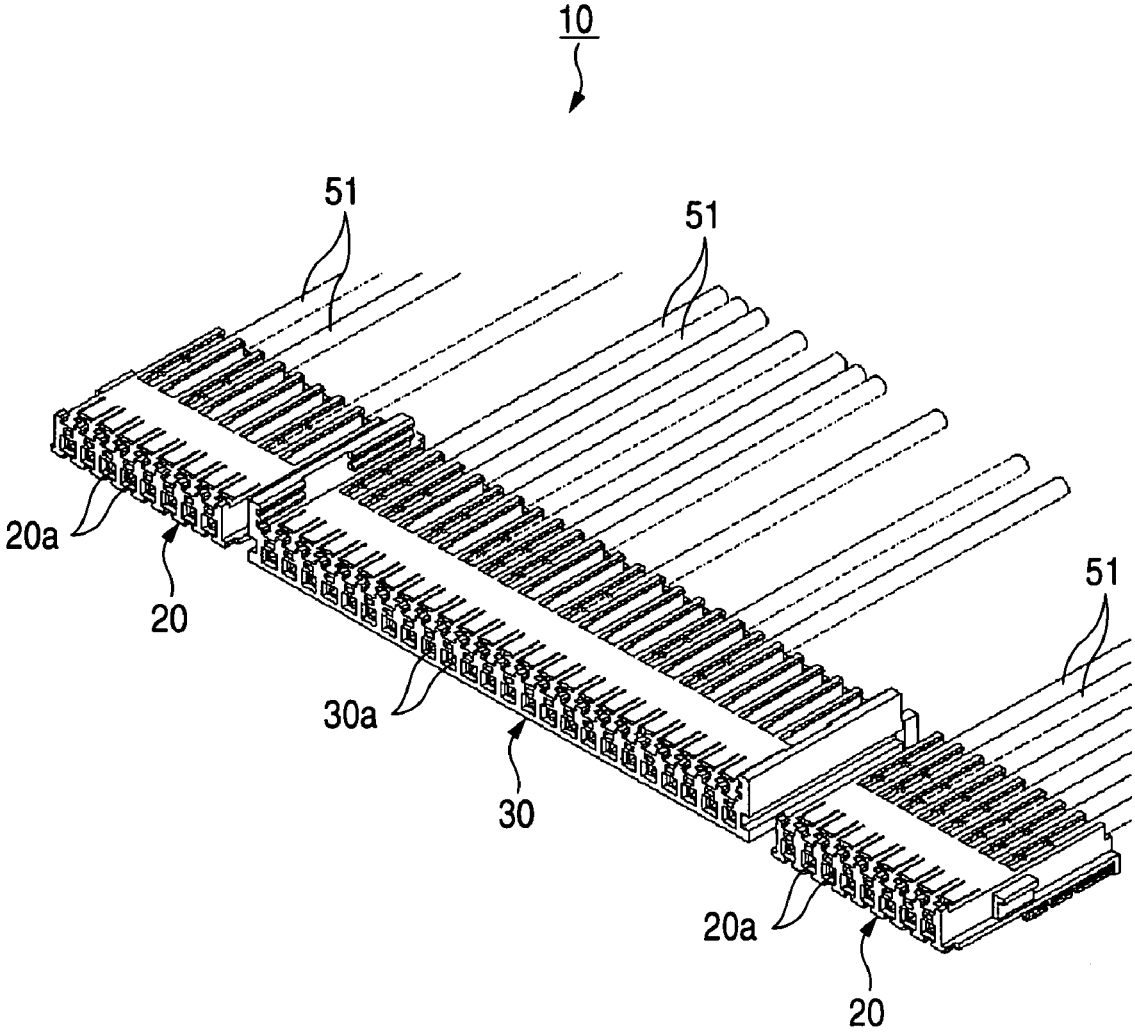
FIG. 4 is a perspective view showing the state the pressure contact terminal inserted into the cavity of the united connector shown in FIG. 1 has been brought into pressure contact with an electric wire.
Figure 5:
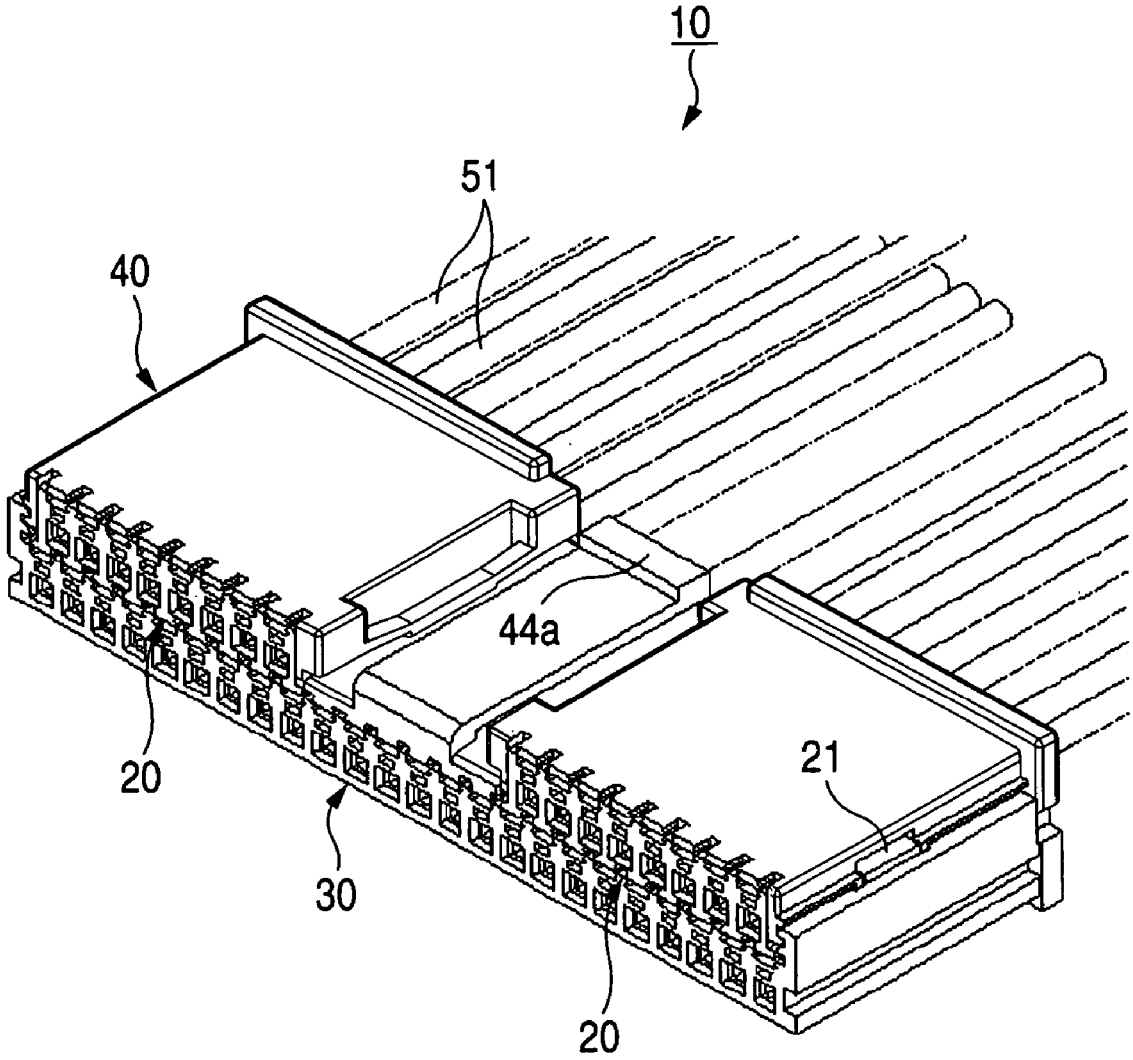
FIG. 5 is a perspective view showing first engagement of each connector housing and cover of the united connector shown in FIG. 1.
Figure 6:
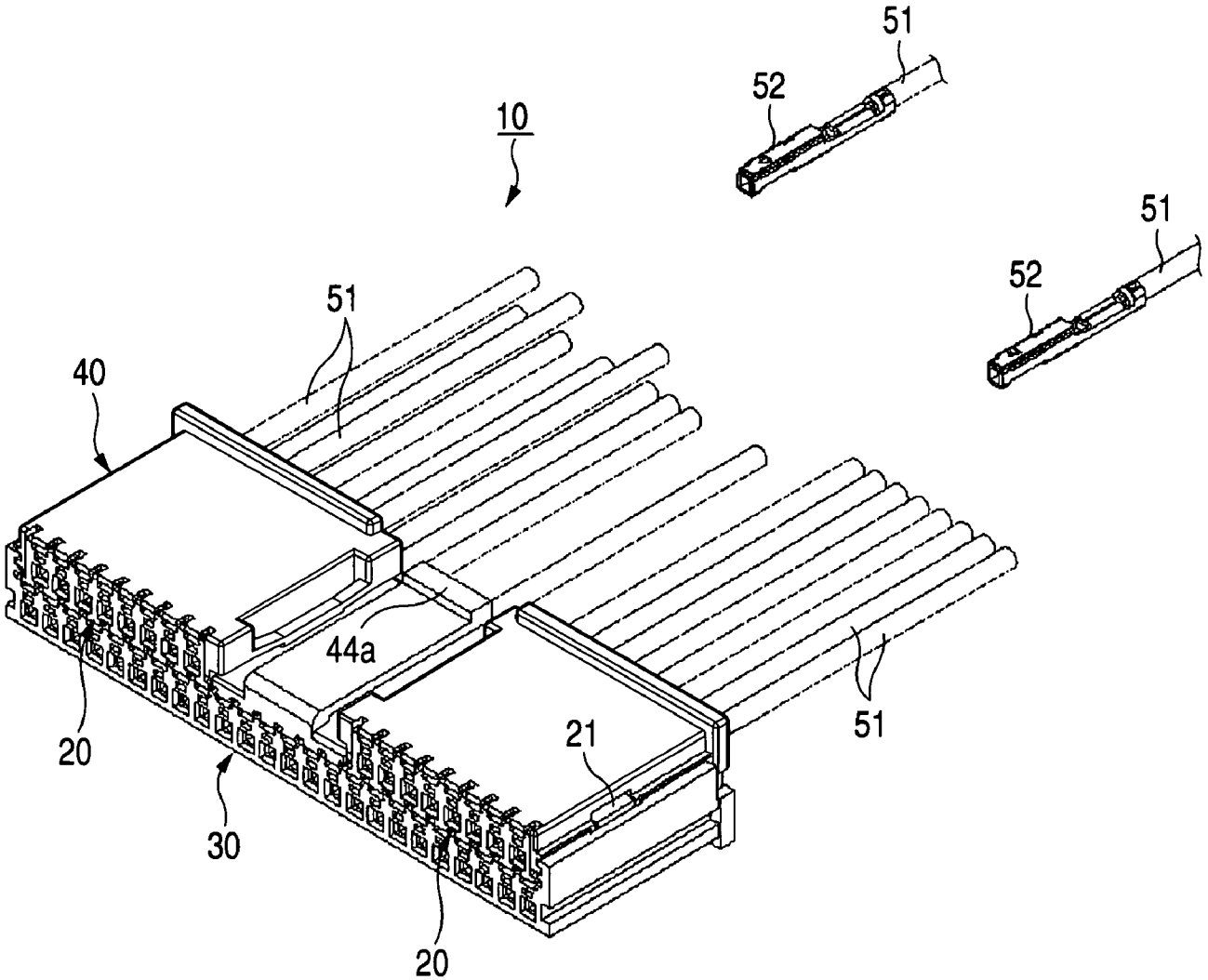
FIG. 6 is a perspective view showing the state before a crimp terminal is inserted into the united connector in the first engagement state shown in FIG. 5.
Figure 7:
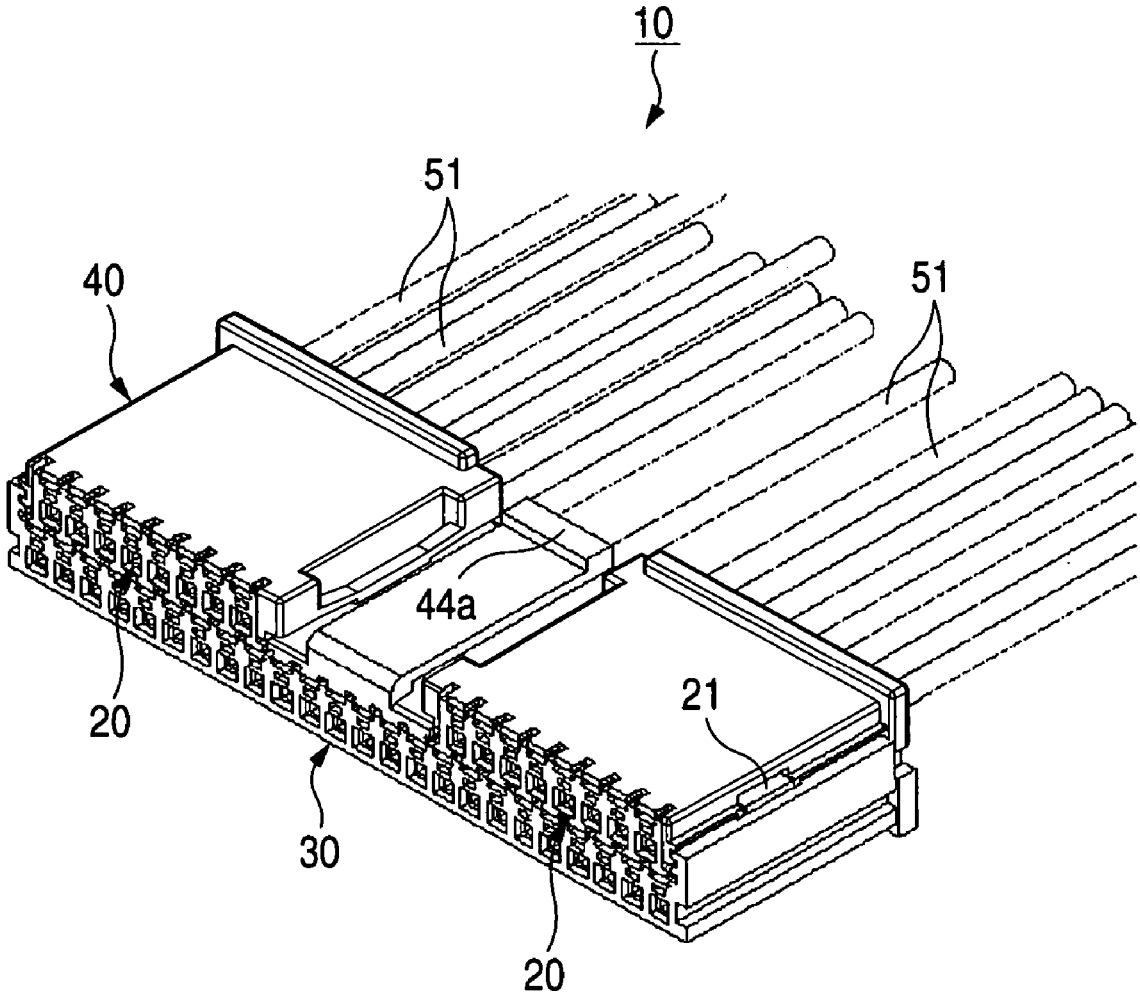
FIG. 7 is a perspective view showing the crimp terminal inserted into the united connector shown in FIG. 6.
Figure 8:
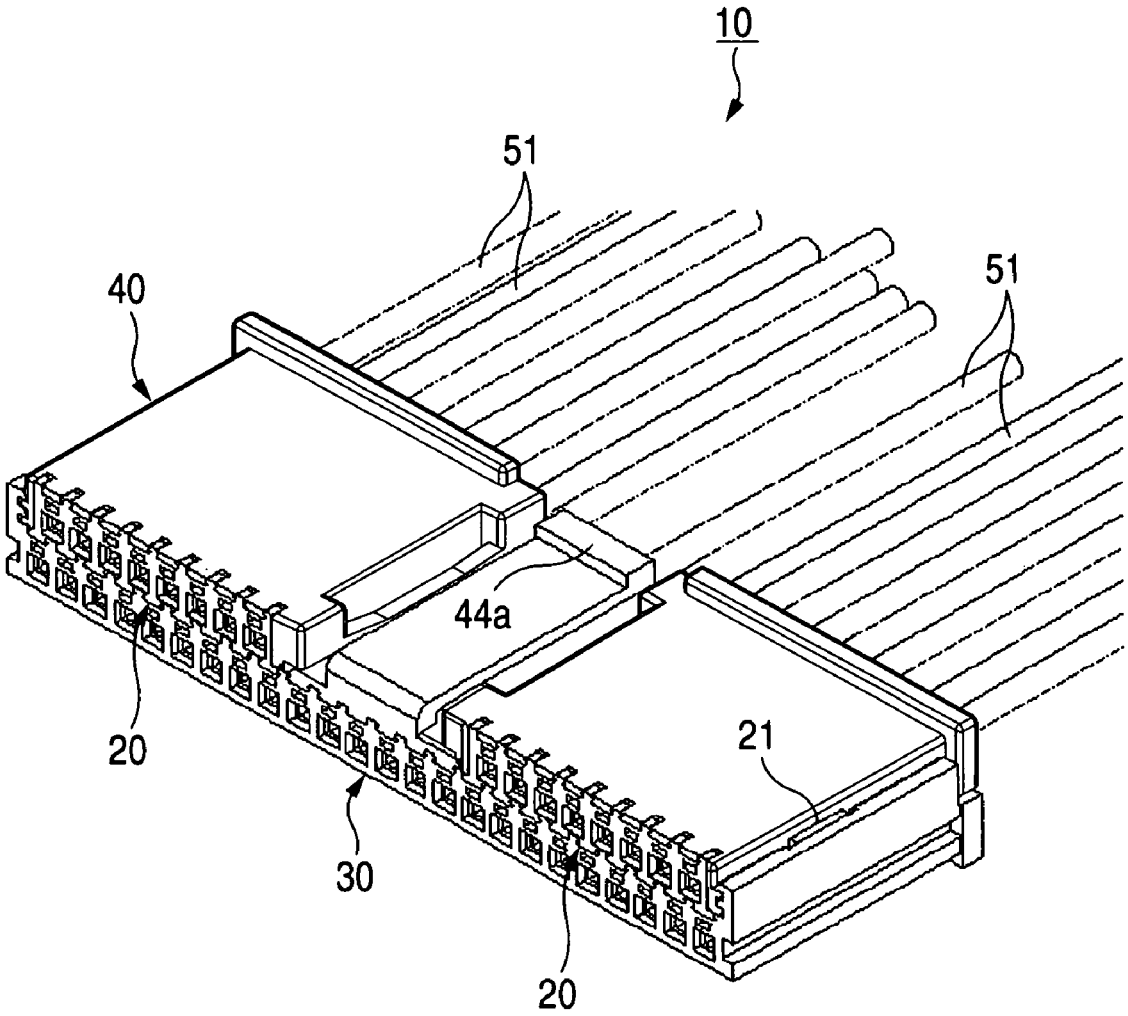
FIG. 8 is a perspective view showing the second engagement state of the united connector shown in FIG. 7 pressed in vertical direction.

FIG. 1 is an exploded perspective view showing the state before union of a united connector as an embodiment of the invention. FIG. 2 is an exploded perspective view showing the state before a pressure contact terminal is inserted into the cavity of the united connector shown in FIG. 1. FIG. 3 is a perspective view showing the state before a pressure contact terminal inserted into the cavity of the united connector shown in FIG. 1 is brought into pressure contact with an electric wire. FIG. 4 is a perspective view showing the state the pressure contact terminal inserted into the cavity of the united connector shown in FIG. 1 has been brought into pressure contact with an electric wire. FIG. 5 is a perspective view showing first engagement of each connector housing and cover of the united connector shown in FIG. 1. FIG. 6 is a perspective view showing the state before a crimp terminal is inserted into the united connector in the first engagement state shown in FIG. 5. FIG. 7 is a perspective view showing the crimp terminal inserted into the united connector shown in FIG. 6. FIG. 8 is a perspective view showing the second engagement state of the united connector shown in FIG. 7 pressed in vertical direction.

Figure 9A:
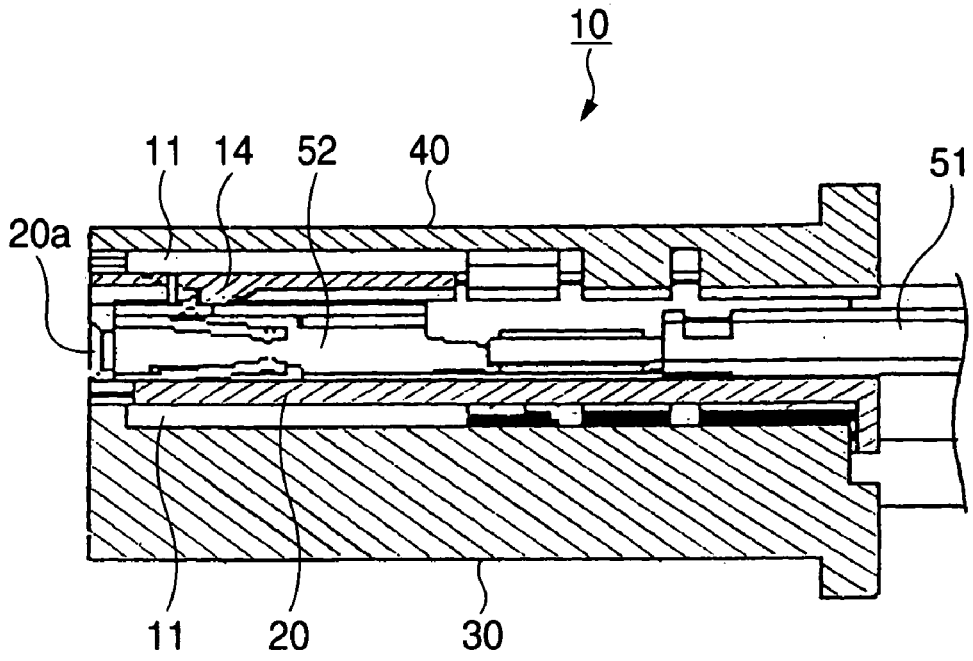
FIGS. 9A and 9B are cross sectional views of a main part showing the united connector according to this embodiment.
Figure 9B:
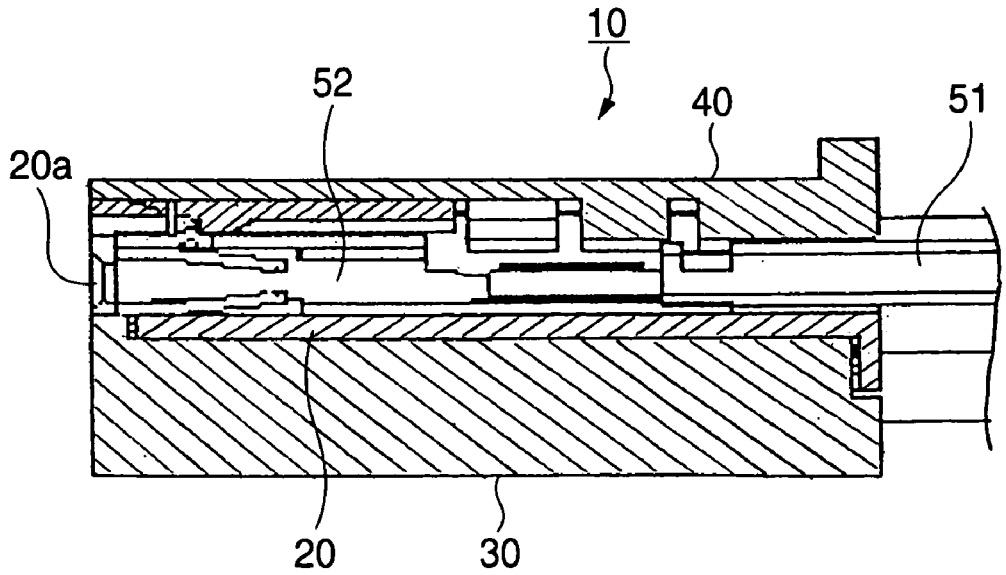
Figure 10A:
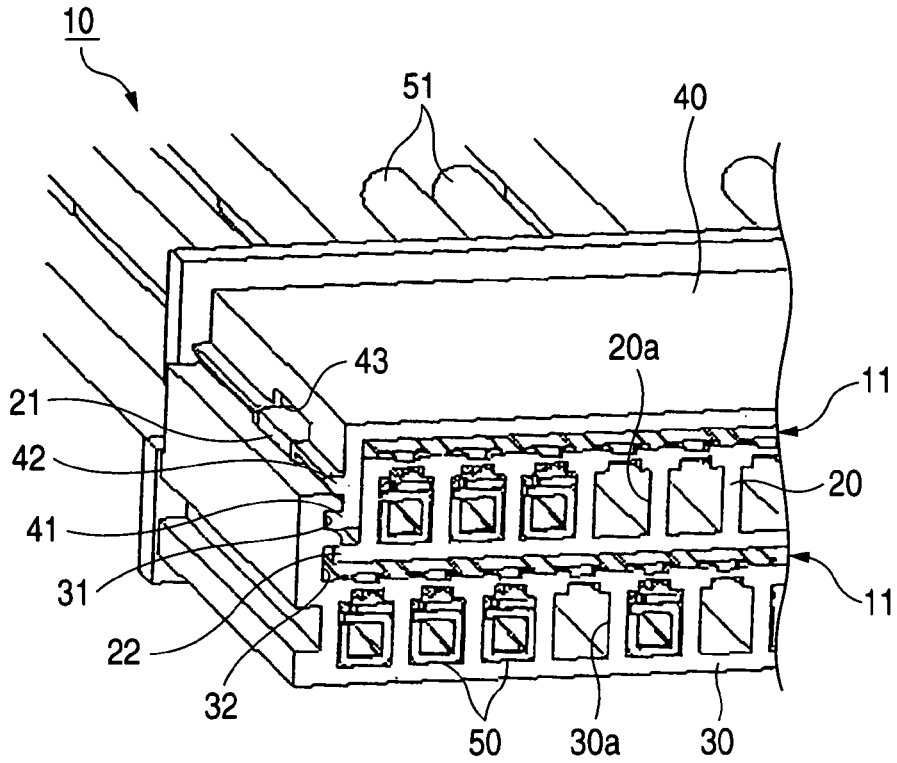
FIGS. 10A and 10B are perspective views of a main part of the united connector shown in FIG. 9.
Figure 10B:
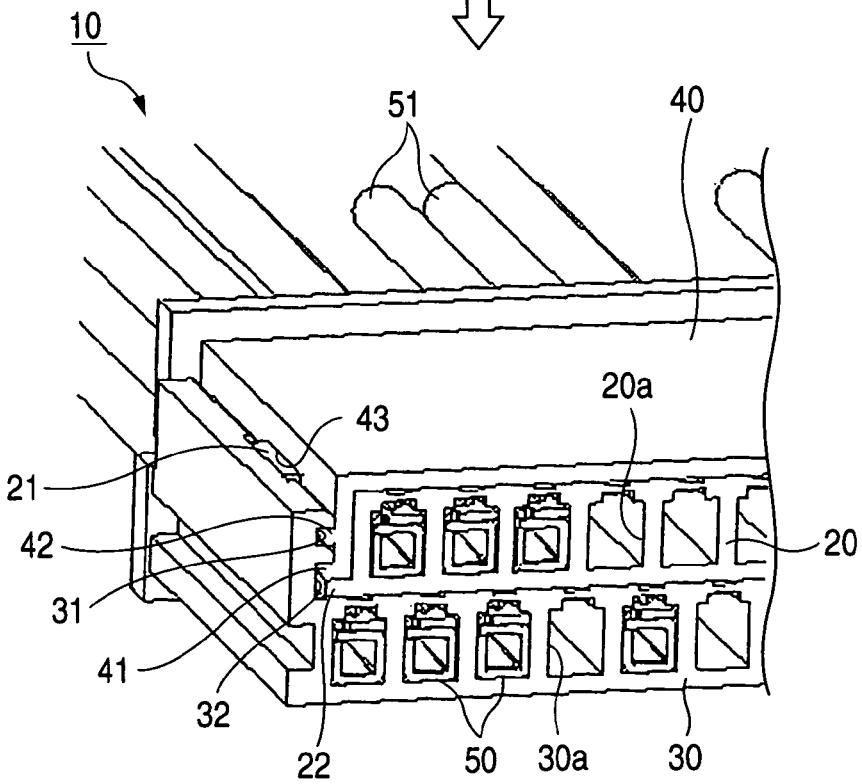
Figure 11A:
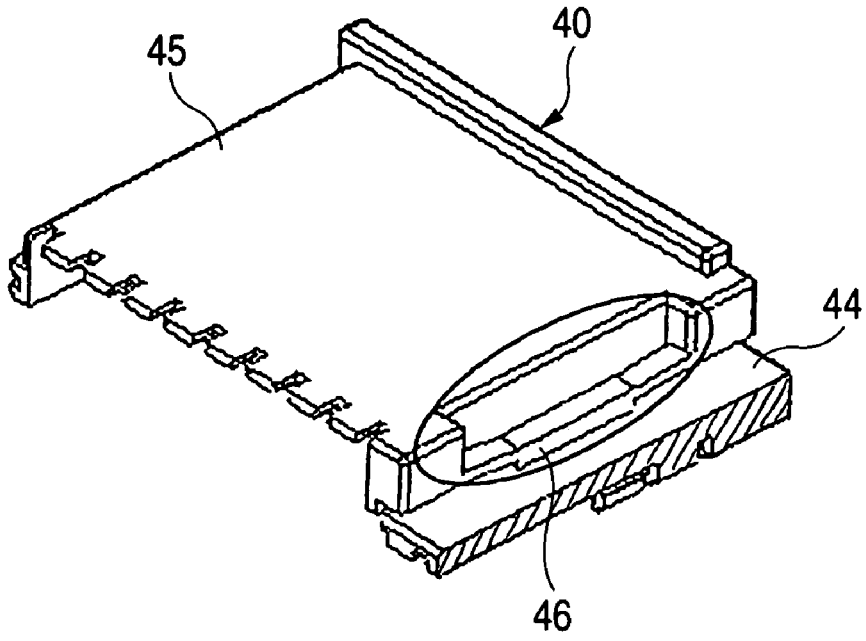
FIGS. 11A and 11B are perspective views of a main part showing the cover of the united connector shown in FIGS. 9A and 9B.
Figure 11B:
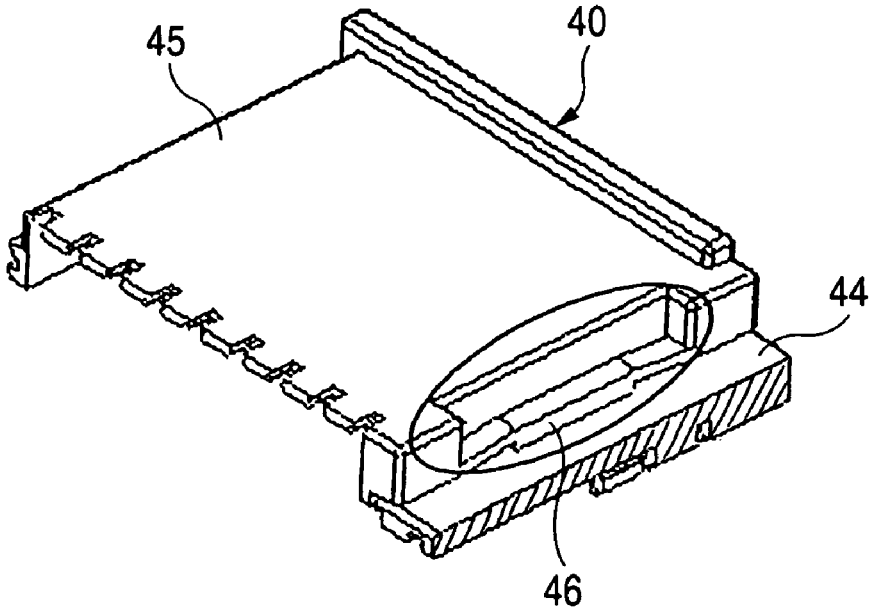
Figure 12A:
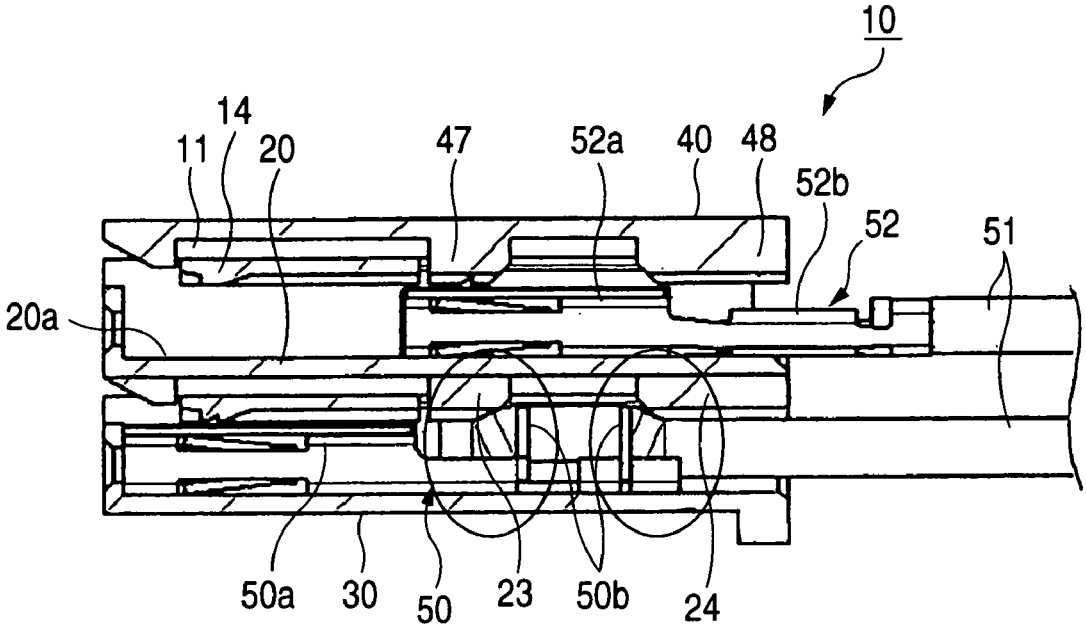
FIGS. 12A and 12B are cross sectional views of a main part of the united connector shown in FIGS. 9A and 9B.
Figure 12B:
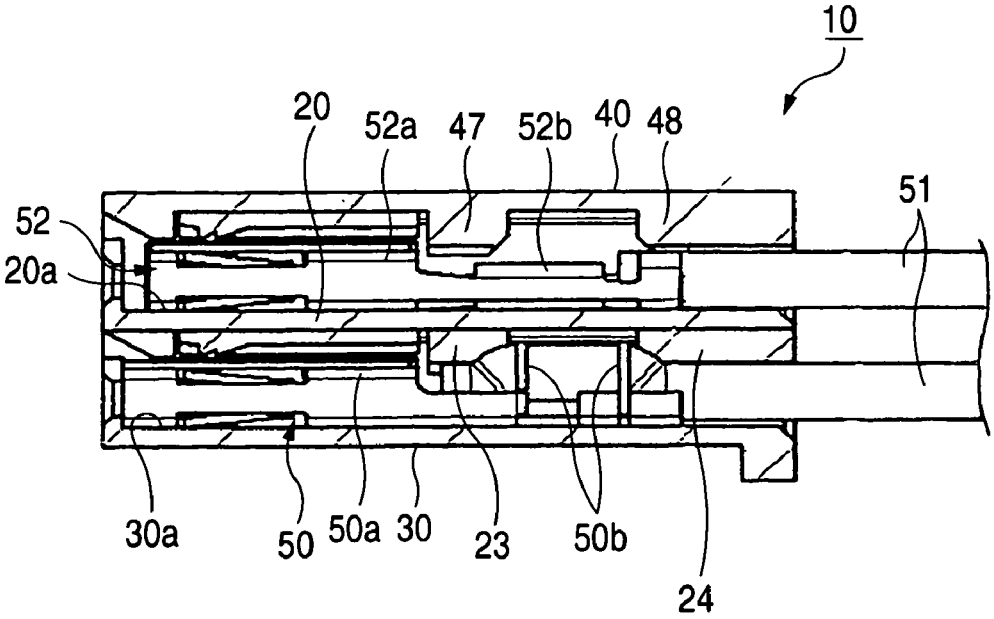
Figure 13:
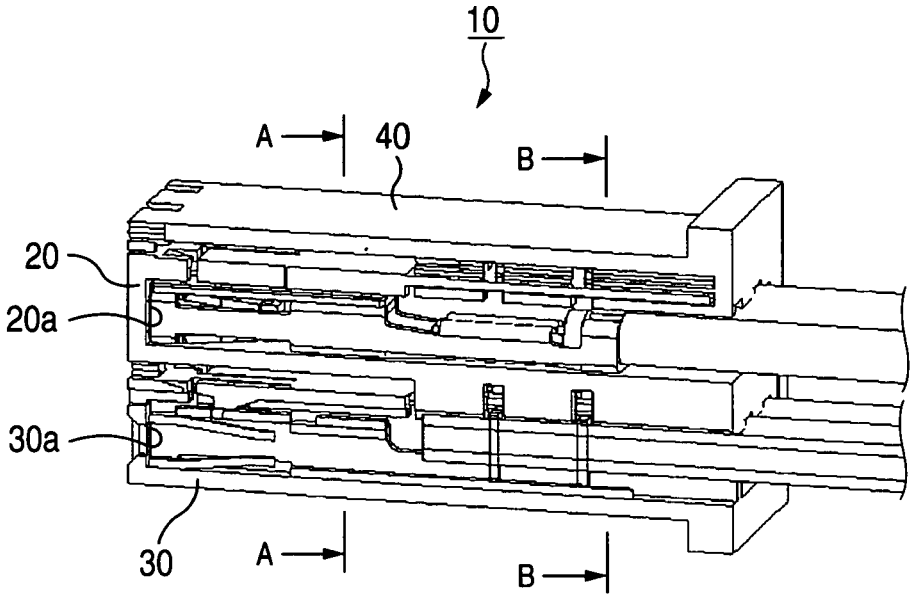
FIG. 13 is a perspective view showing the vertical cross section of the united connector in the first engagement state.
Figure 14:
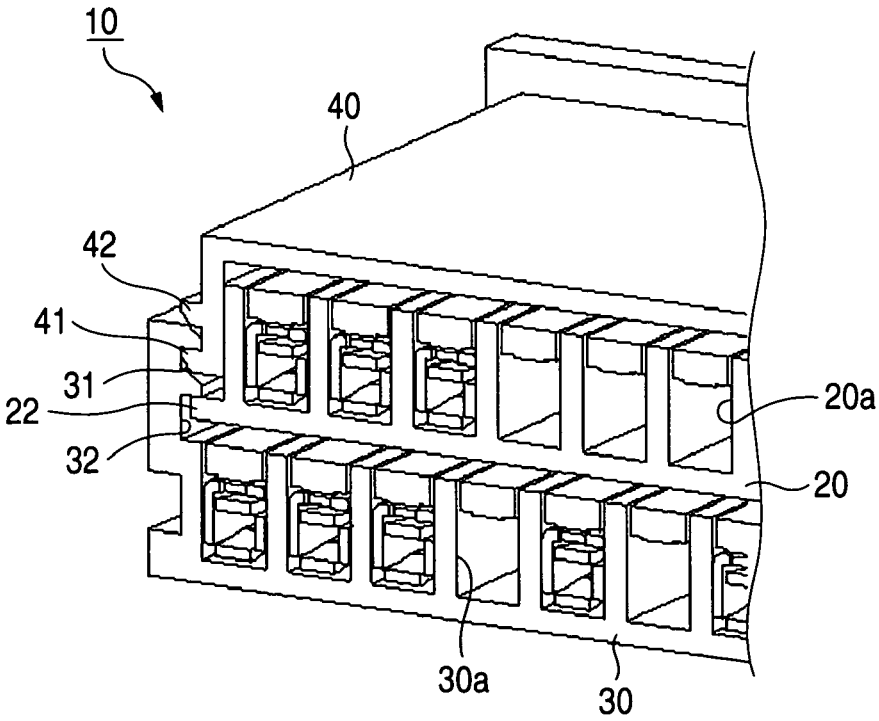
FIG. 14 is a perspective view showing the section A—A of the united connector shown in FIG. 13.
Figure 15:
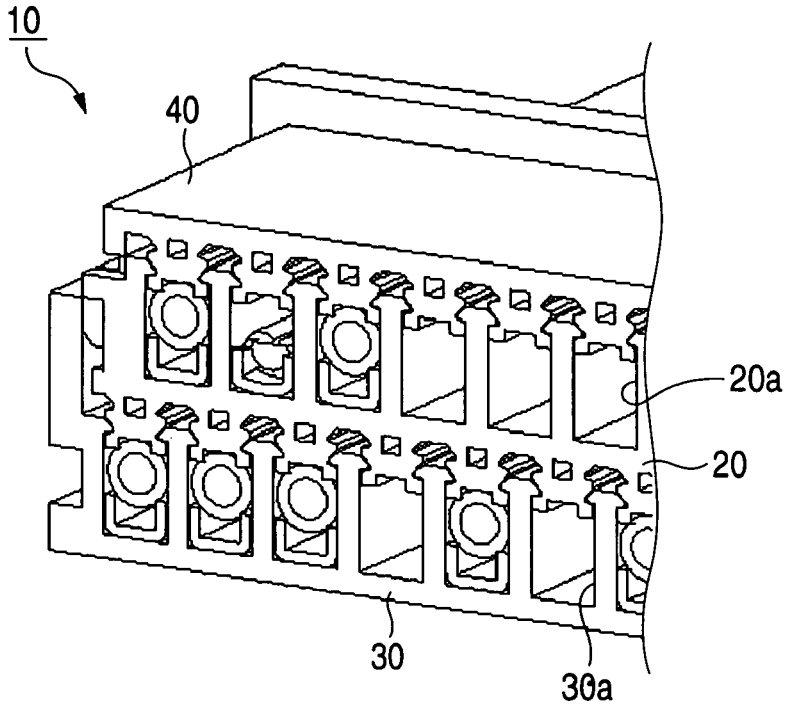
FIG. 15 is a perspective view showing the section B—B of the united connector shown in FIG. 13.
Figure 16:
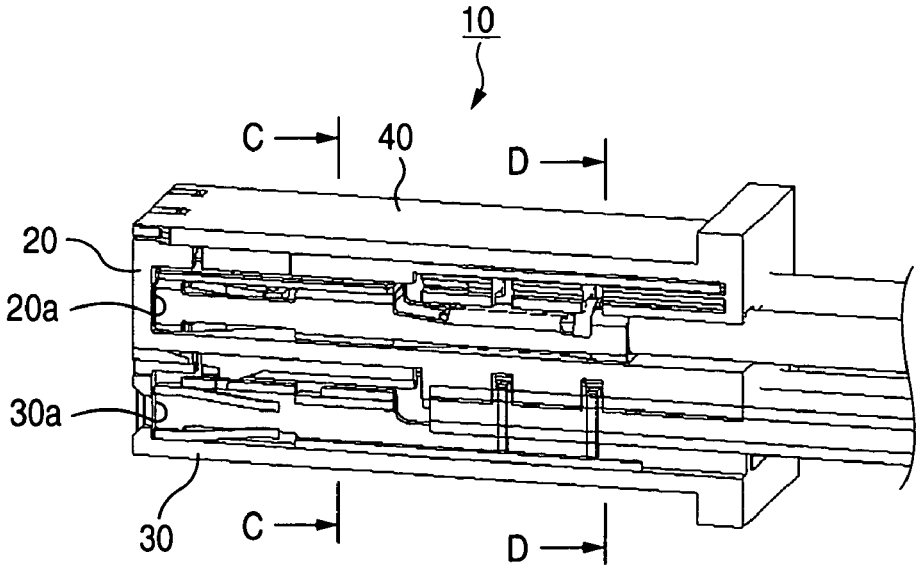
FIG. 16 is a perspective view showing the vertical cross section of the united connector in the second engagement state.
Figure 17:
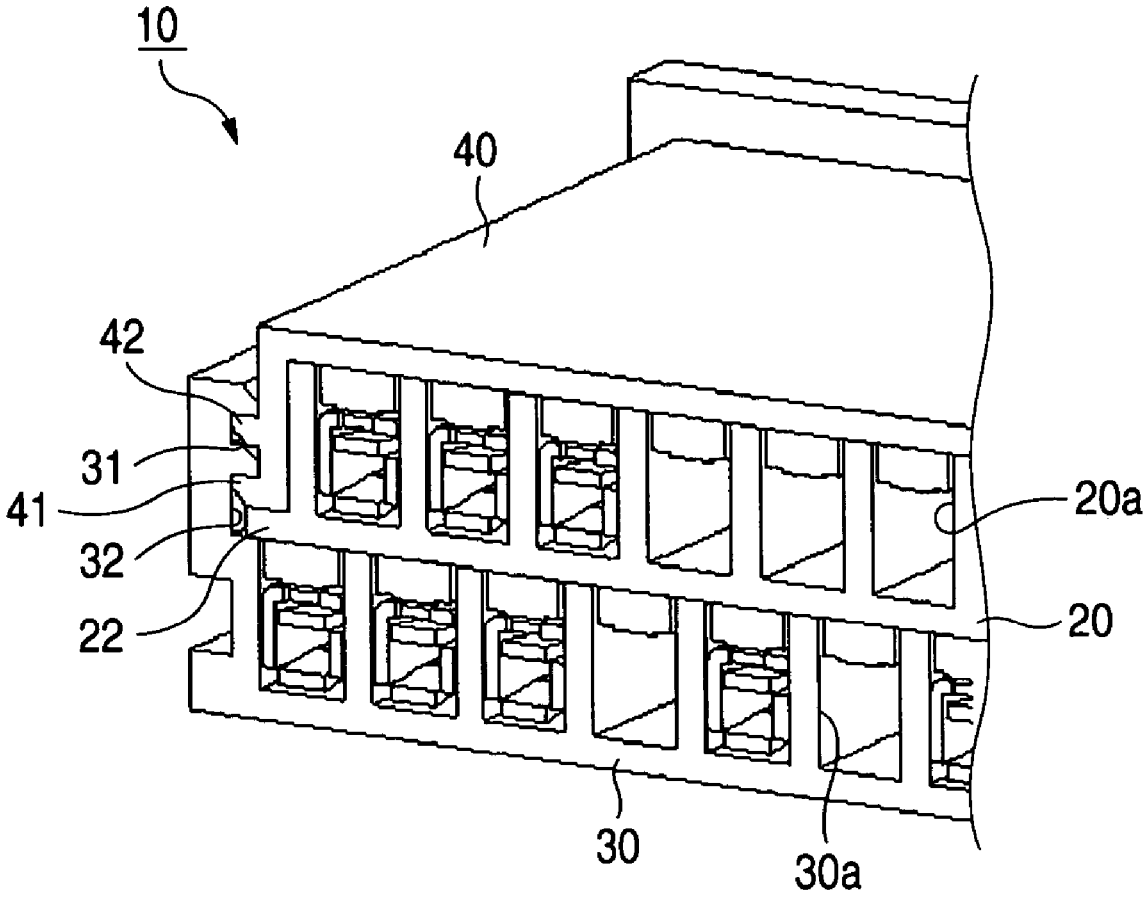
FIG. 17 is a perspective view showing the section C—C of the united connector shown in FIG. 16.
Figure 18:
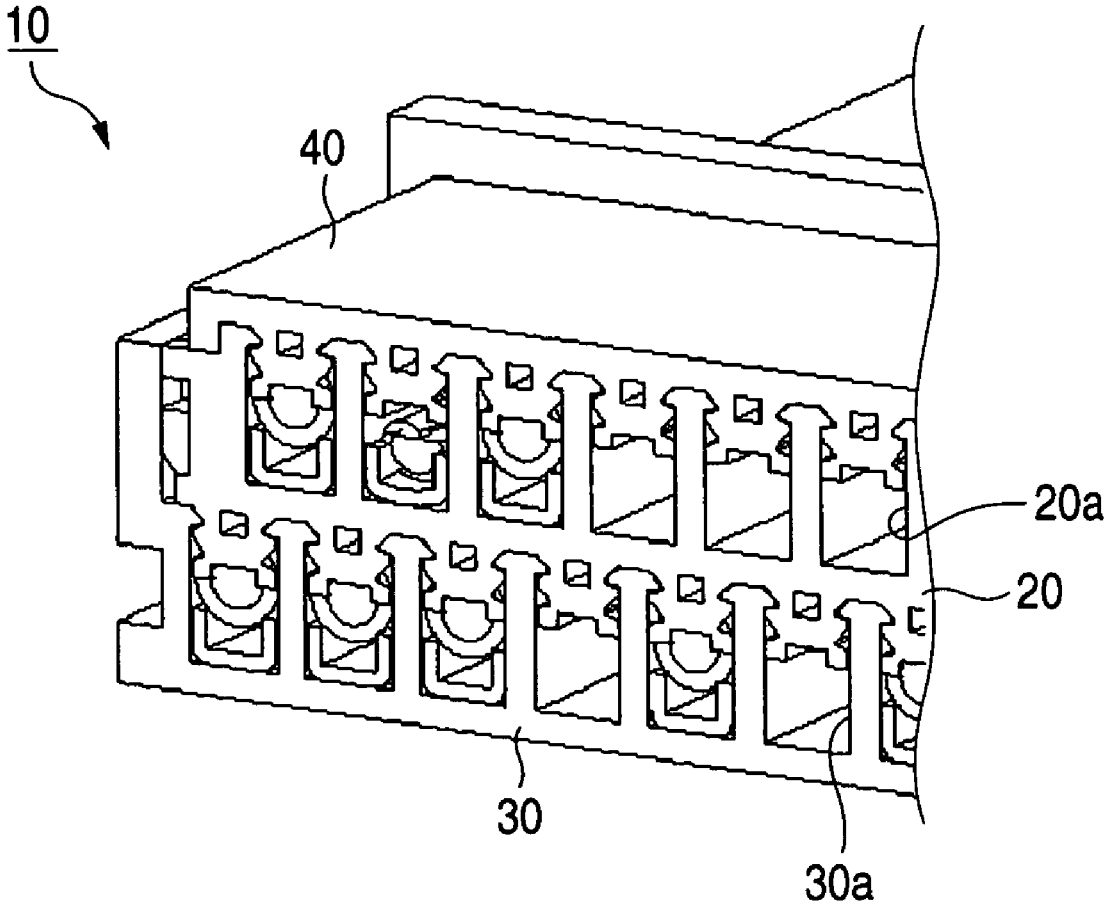
FIG. 18 is a perspective view showing the section D—D of the united connector shown in FIG. 16.

FIGS. 9A and 9B are cross sectional views of a main part showing the united connector according to this embodiment. FIGS. 9A and 9B respectively show the first engagement state and the second engagement state. FIGS. 10A and 10B are perspective views of a main part of the united connector shown in FIG. 9. FIGS. 10A and 10B respectively show the first engagement state and the second engagement state. FIGS. 11A and 11B are perspective views of a main part showing the cover of the united connector shown in FIG. 9. FIGS. 11A and 11B respectively show the first engagement state and the second engagement state. FIGS. 12A and 12B are cross sectional views of a main part of the united connector shown in FIG. 9. FIGS. 12A and 12B respectively show the first engagement state and the second engagement state. FIG. 13 is a perspective view showing the vertical cross section of the united connector in the first engagement state. FIG. 14 is a perspective view showing the section A—A of the united connector shown in FIG. 13. FIG. 15 is a perspective view showing the section B—B of the united connector shown in FIG. 13. FIG. 16 is a perspective view showing the vertical cross section of the united connector in the second engagement state. FIG. 17 is a perspective view showing the section C—C of the united connector shown in FIG. 16. FIG. 18 is a perspective view showing the section D—D of the united connector shown in FIG. 16.

Figure 19:
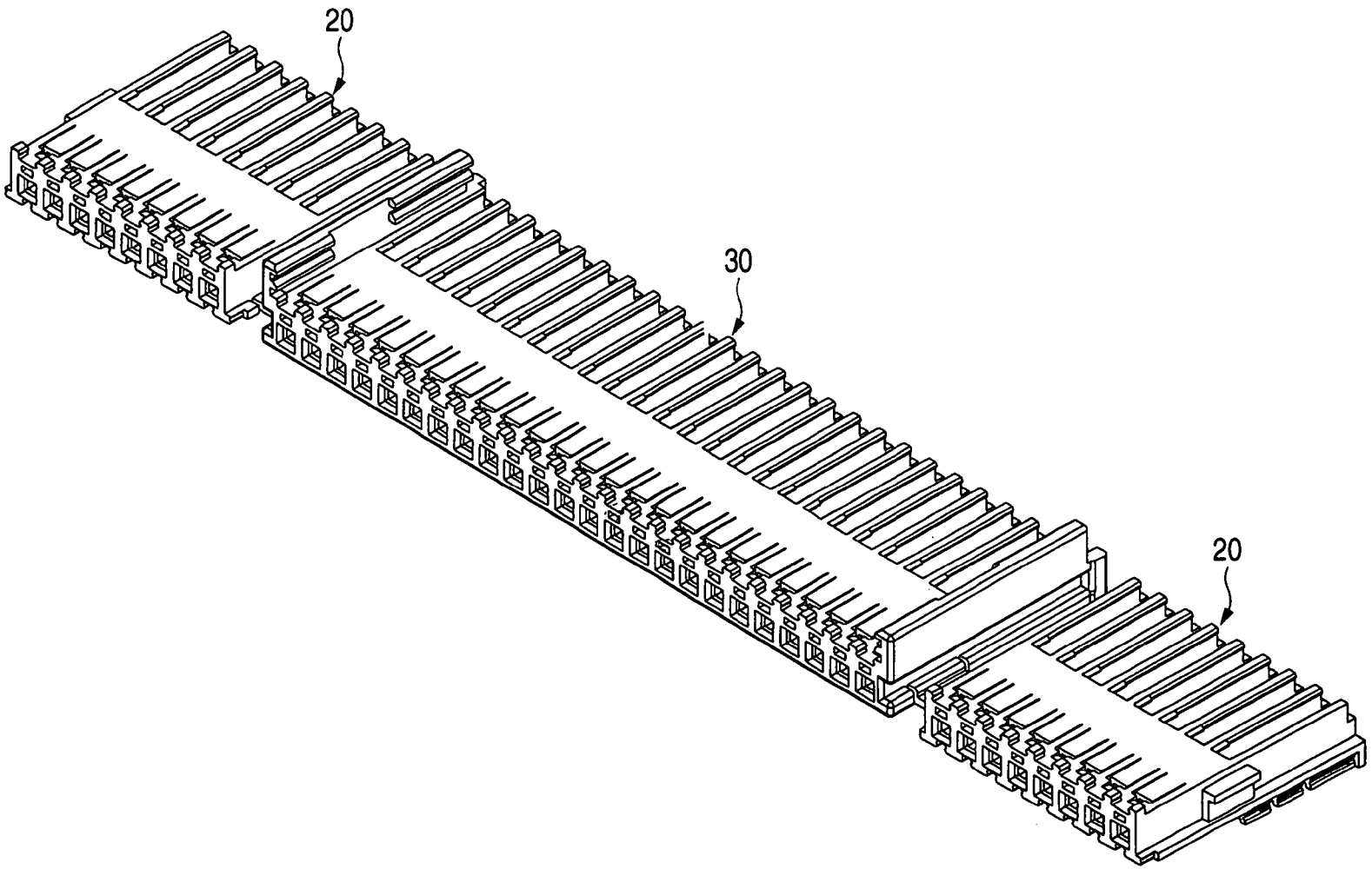
FIG. 19 is a perspective view showing a connector housing before the united connector shown in FIG. 1 is disengaged.
Figure 20:
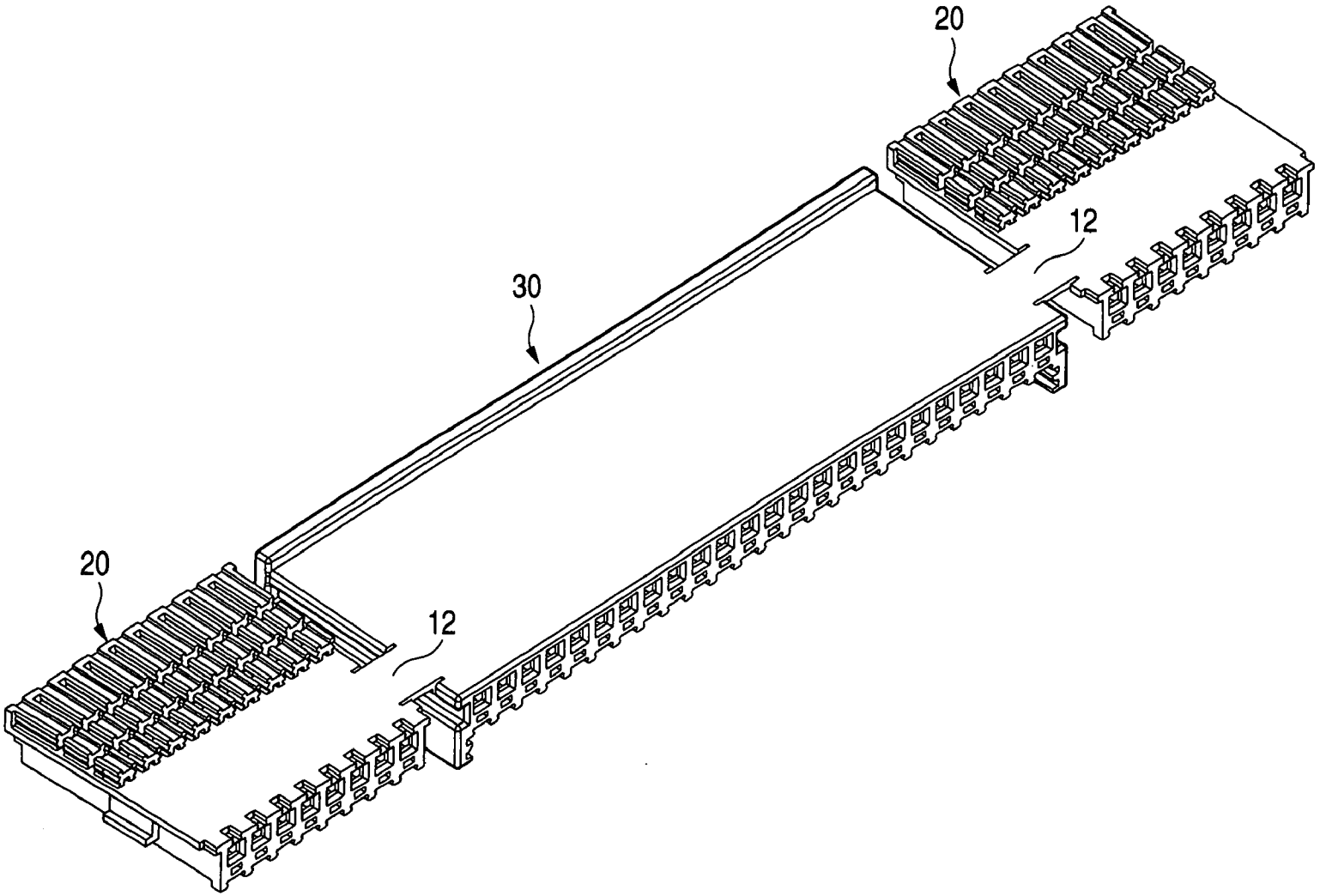
FIG. 20 is a perspective view showing the rear side of the connector housing shown in FIG. 19.
Figure 21:
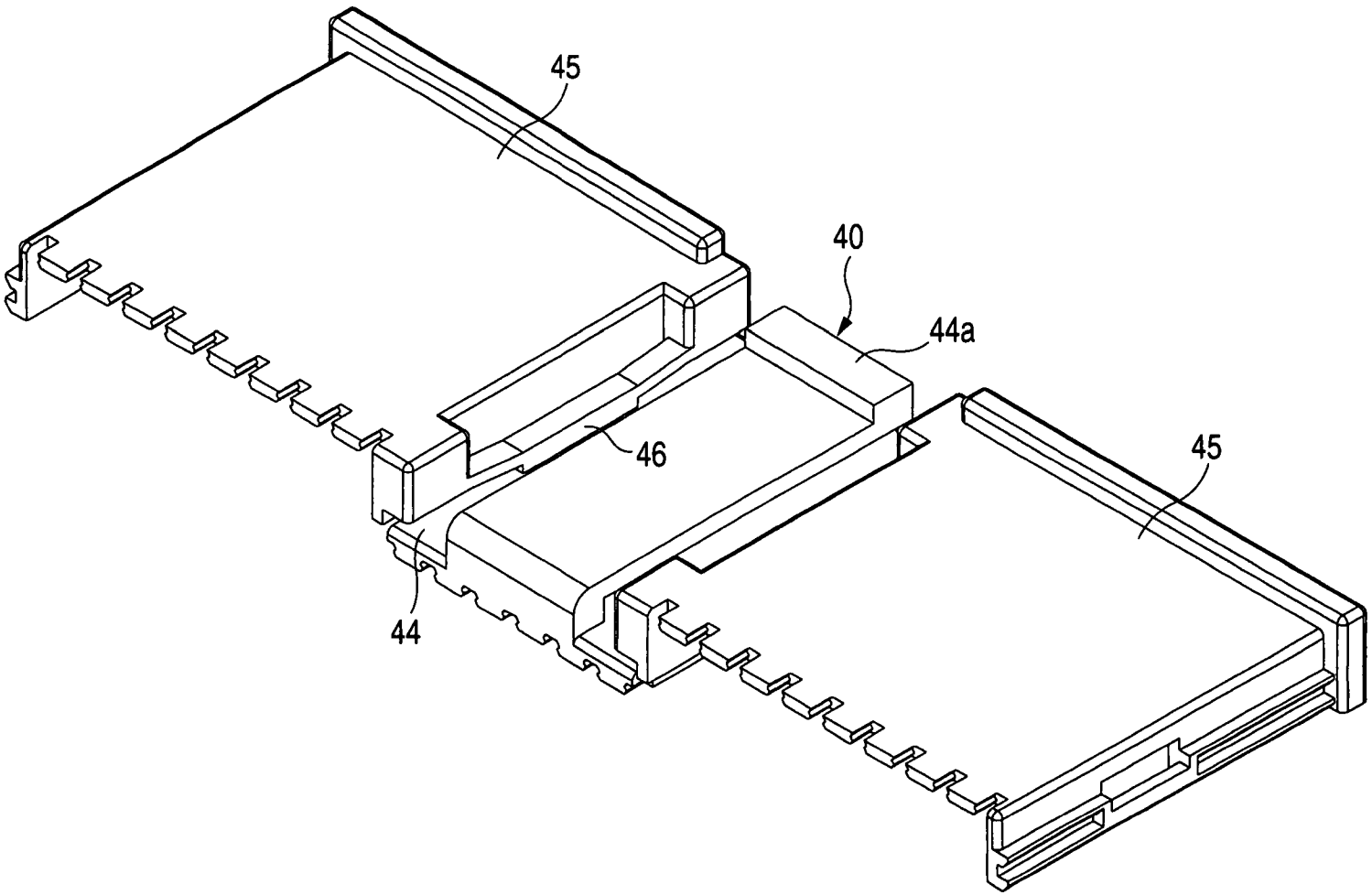
FIG. 21 is a perspective view showing the cover of the united connector shown in FIG. 1.
Figure 22:
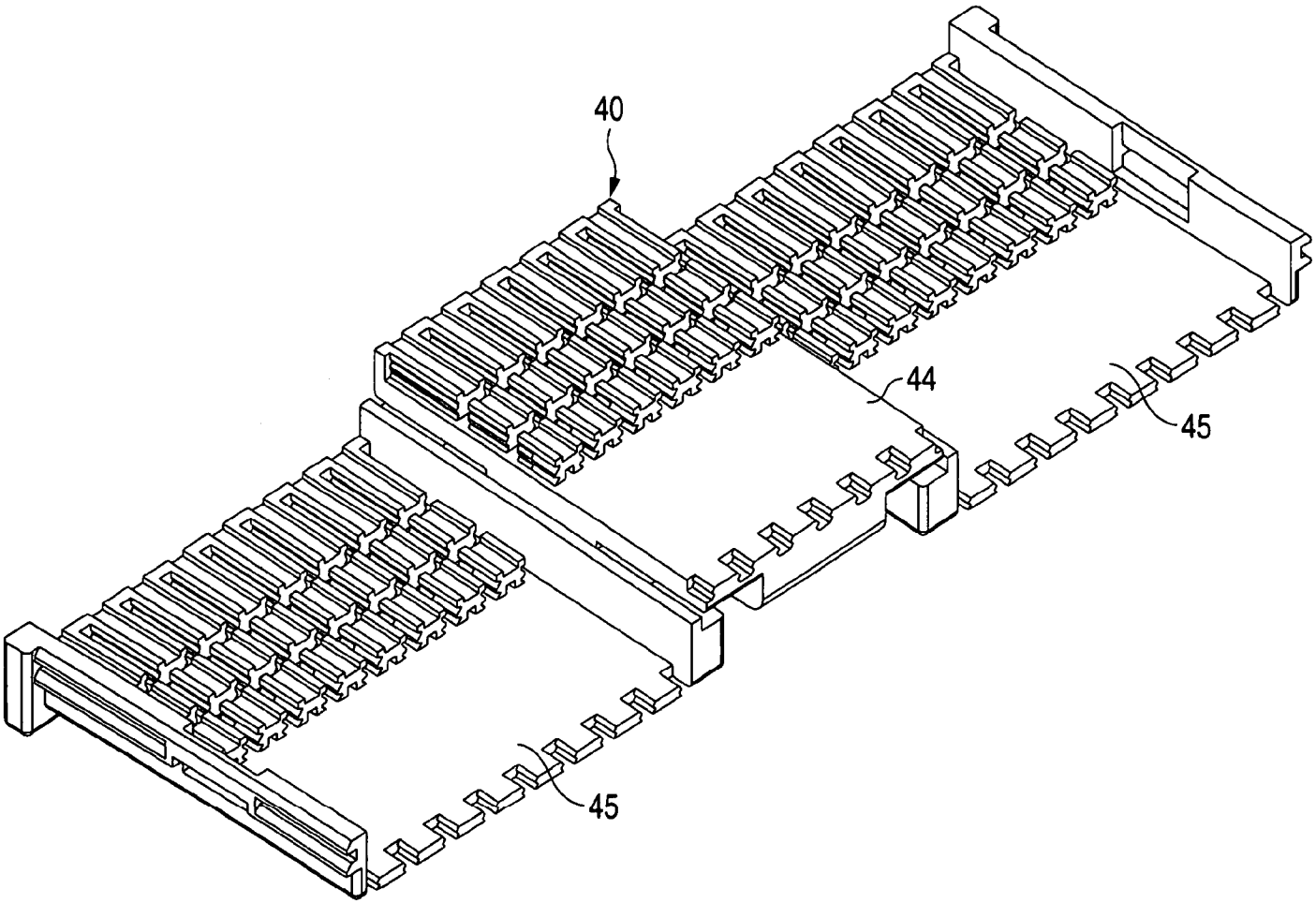
FIG. 22 is a perspective view showing the rear side of the cover shown in FIG. 21.
Figure 23A:
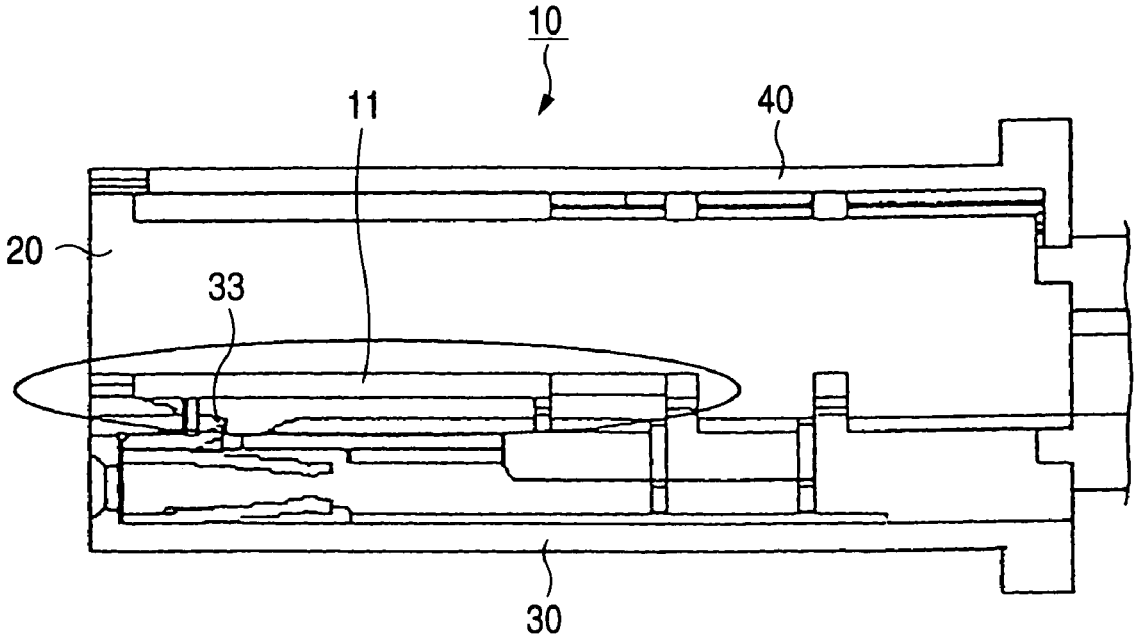
FIGS. 23A and 23B are cross sectional views of a main part showing the united connector according to this embodiment.
Figure 23B:
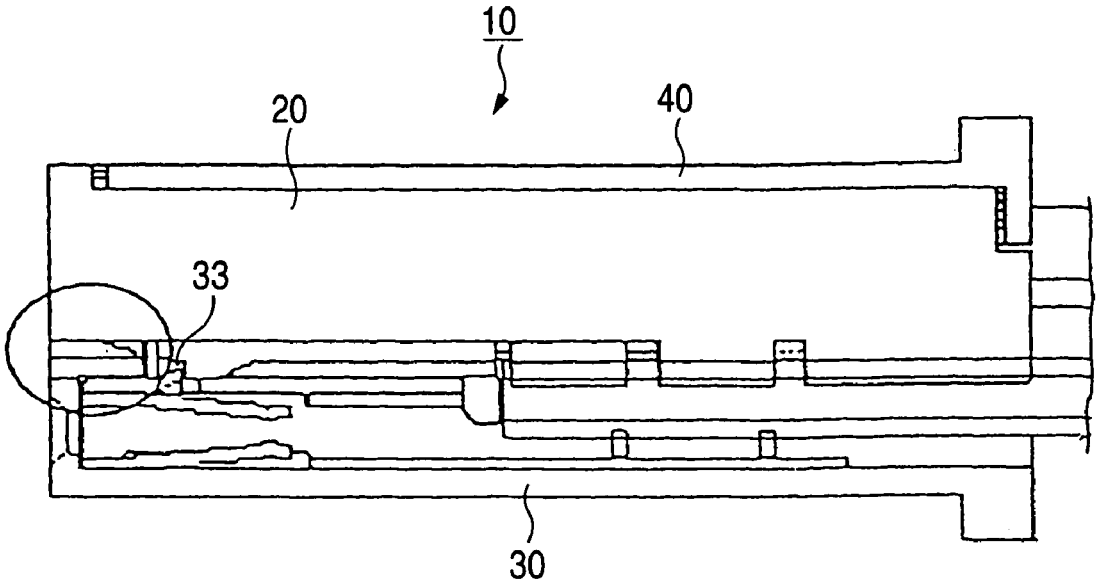
Figure 24:
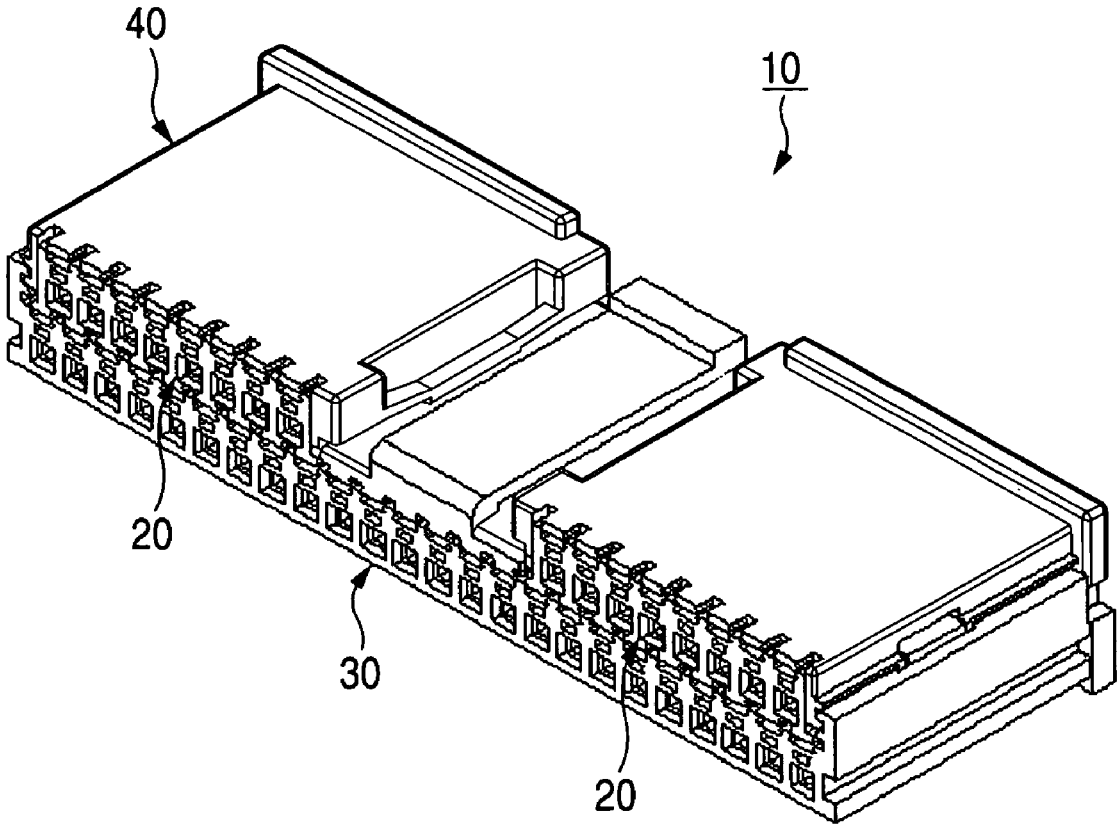
FIG. 24 is a perspective view showing the first engagement state of a united connector without pressure contact connection.
Figure 25:
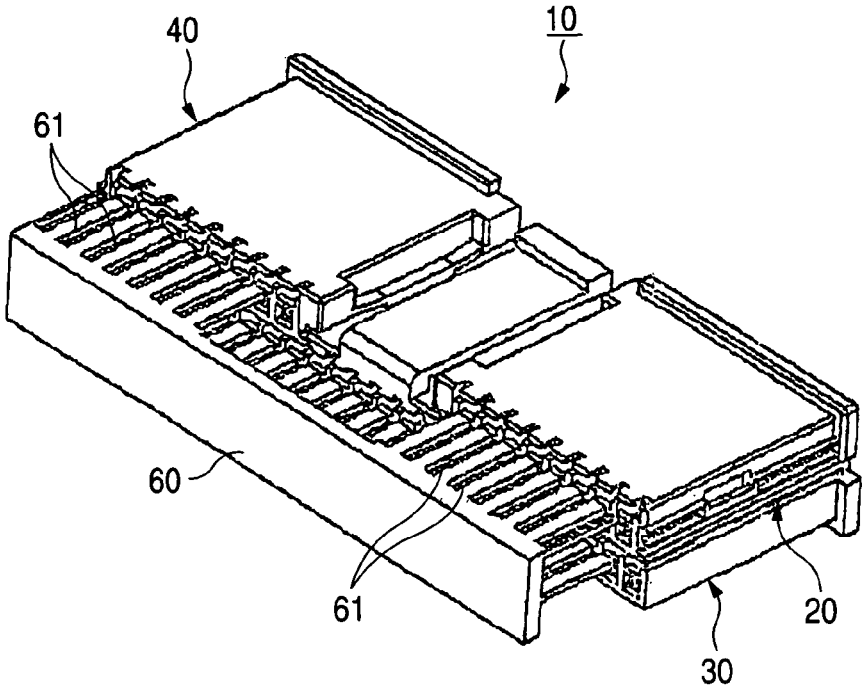
FIG. 25 is a perspective view showing a united connector and a spacer jig used for first engagement of the united connector.
Figure 26:
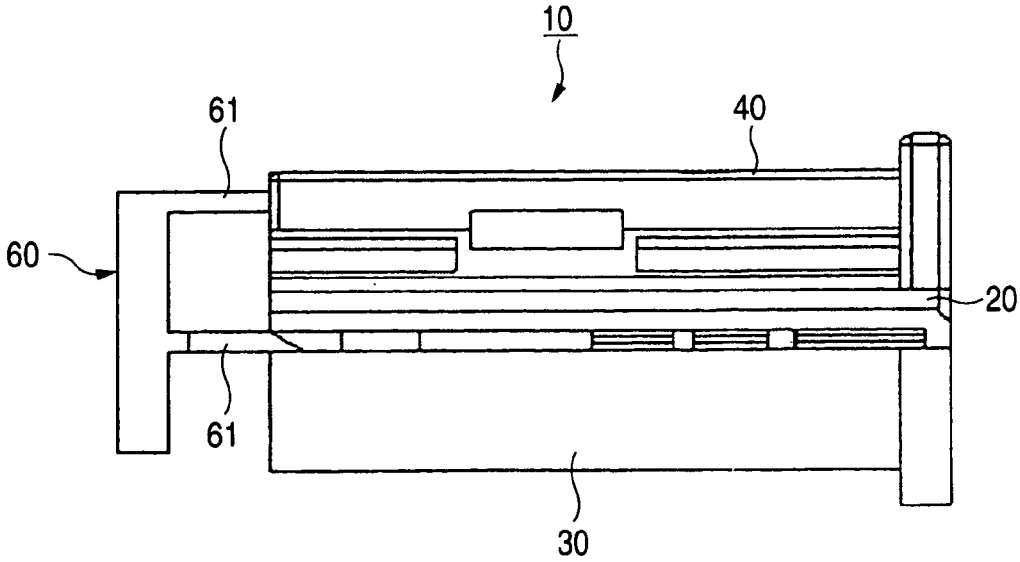
FIG. 26 is aside view of FIG. 25.
Figure 27:
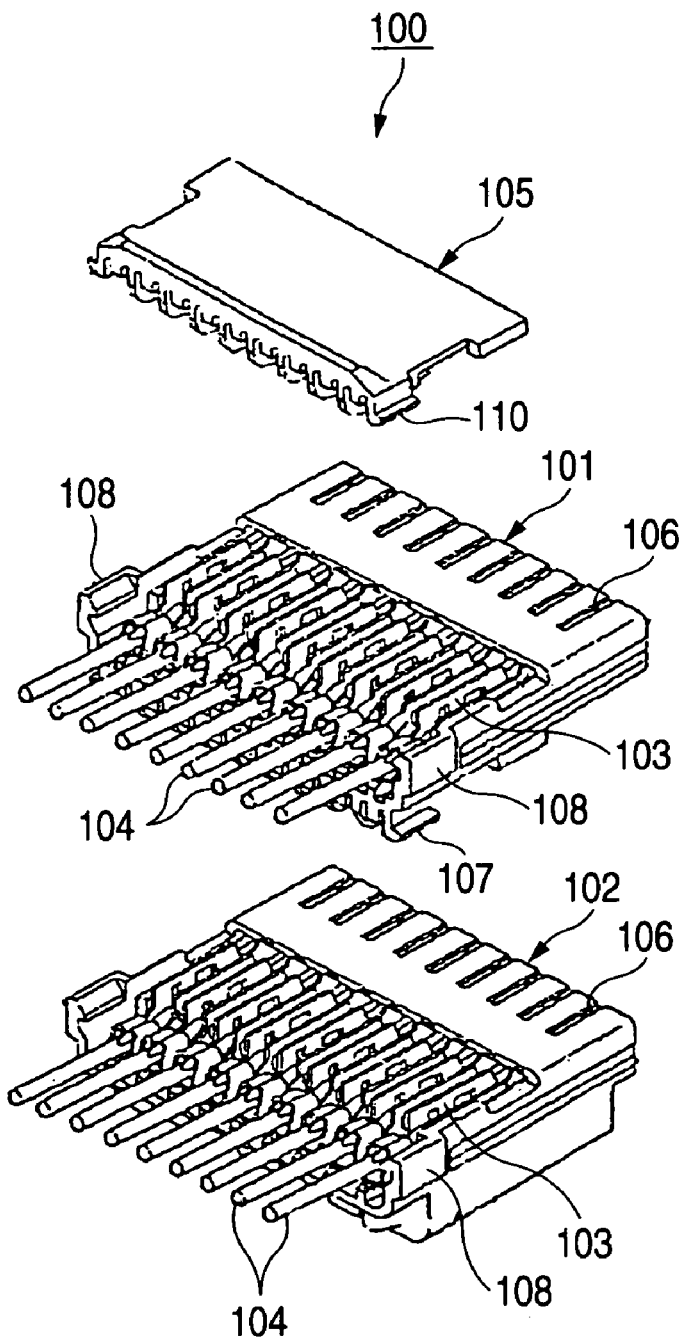
FIG. 27 is an exploded perspective view showing the connector disclosed in JP-A-10-69936.
Figure 28:
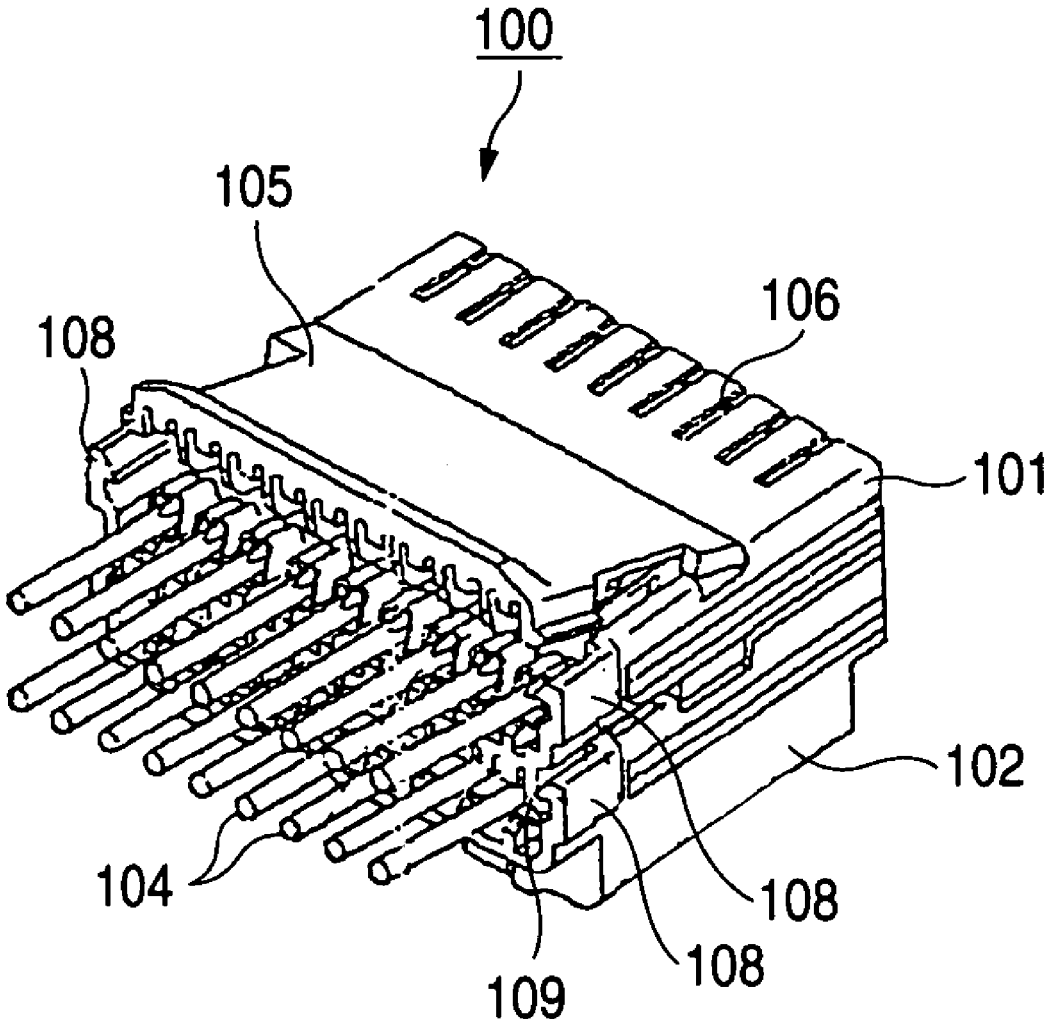
FIG. 28 is a perspective view showing the union state of the connector shown in FIG. 27.
Figure 29:
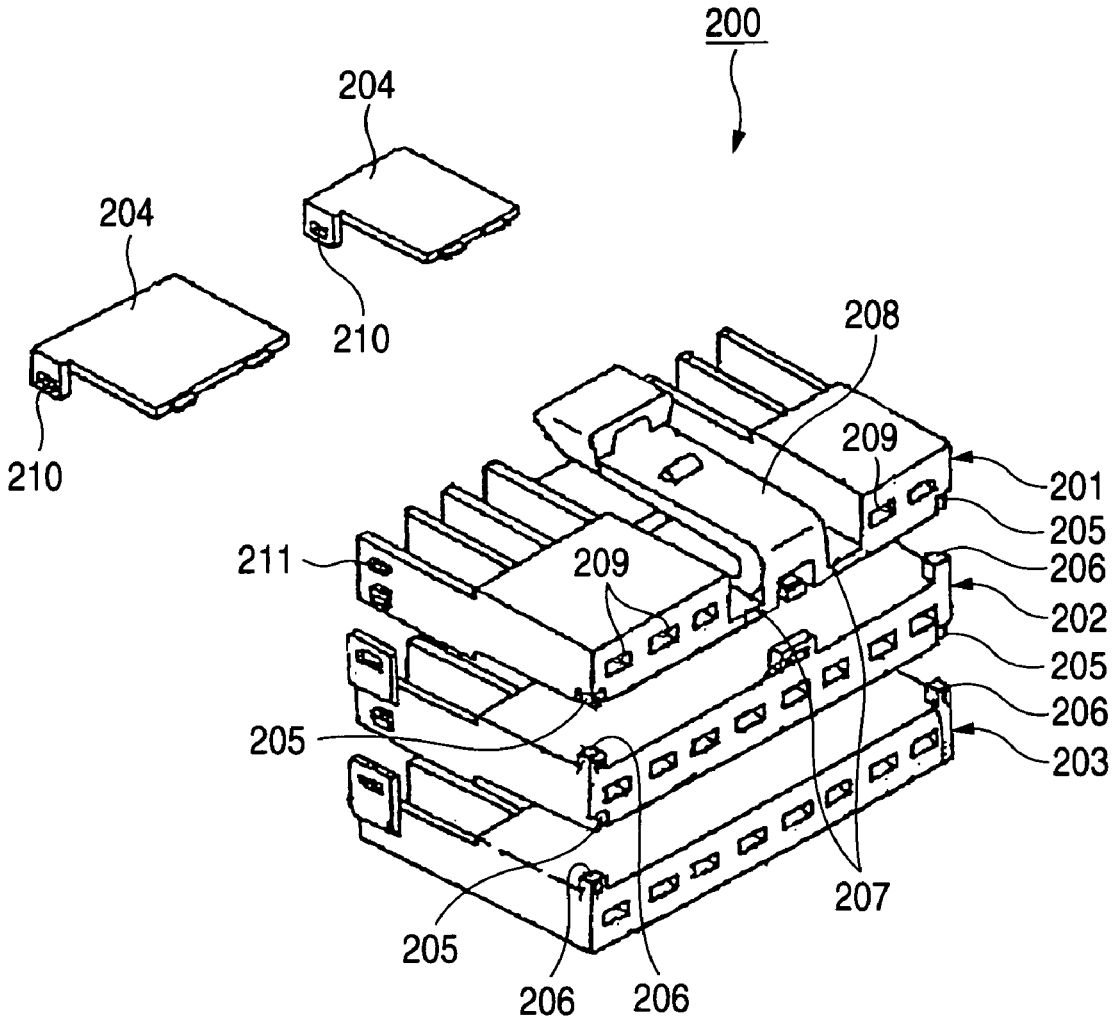
FIG. 29 is an exploded perspective view showing the pressure contact connector as the connector disclosed in Japanese Utility Model No. 2,518,968.

FIG. 19 is a perspective view showing the connector housing before the united connector shown in FIG. 1 is disunited. FIG. 20 is a perspective view showing the rear side of the connector housing shown in FIG. 19. FIG. 21 is a perspective view showing the cover of the united connector shown in FIG. 1. FIG. 22 is a perspective view showing the rear side of the united connector shown in FIG. 21. FIGS. 23A and 23B are cross sectional views showing the united connector according to this embodiment. FIGS. 23A and 23B respectively show the first engagement state and the second engagement state. FIG. 24 is a perspective view showing the first engagement state of the united connector without pressure contact connection. FIG. 25 is a perspective view showing the united connector and a spacer jig used for first engagement of the united connector. FIG. 26 is a side view of FIG. 25.

Referring to FIGS. 1 through 22, the united connector 10 includes a plurality of connector housings 20, 30 that may be layered in multiple stages (two vertical stages in this embodiment) and a cover 40 that is locked to the upper connector housings 20 and covers the top of the upper connector housings 20 and lower connector housing 30 that have been layered. Crimp terminals 52 connected to a pressure contact terminal 50 and an electric wire 51 are inserted into the cavities 20*a*, 30*a* of the connector housings 20, 30. The electric wire 51 is connected in pressure contact with the pressure contact terminal 50.

In the united connector 10, the upper connector housings 20 are coupled to both ends of the lower connector housing 30 via hinges (refer to FIG. 20) with a clearance twice as wide as the cavity before the united connector is assembled, as shown in FIG. 1. While the upper connector housings 20 and the lower connector housing 30 are in the coupled state, pressure contact terminals 50 are inserted into the cavities 20*a*, 30*a* of the upper and lower connector housings 20, 30 from behind as shown in FIG. 2. Furthermore, the electric wires 51 are connected in pressure contact to the pressure contact terminals 50 from above as shown in FIG. 3.

In this state, as shown in FIG. 4, a hinge 12 is cut out. As shown in FIG. 5, the upper connector housing 20 is layered on the top of the lower connector housing 30 and a cover 40 is layered on the top upper connector housings 20 for first engagement. The upper connector housings 20 and the lower connector housing 30 have crimp terminals 52 connected to the electric wires 51 from behind inserted into the cavities 20*a*, 30*a* as shown in FIGS. 6 and 7 and pressed in vertical direction so as to be brought into the second engagement state shown in FIG. 8.

As shown in FIGS. 5 through 7, FIG. 9A, FIG. 10A, FIG. 11A, FIG. 12A and FIGS. 13 through 15, the united connector 10 has pressure contact terminals 50 inserted into the cavities 20*a*, 30*a* and has a space 11 for inserting a crimp terminal inserted between connector housings 20 and 30 and between the upper connector housing 20 and the cover 40. The space 11 for inserting a crimp terminal allows the deformation of a terminal locking lance 14 to insert the crimp terminal.

After the crimp terminal 52 is inserted into the connector housings 20 (state shown in FIG. 7), the united connector 10 is pressed in vertical direction shown in FIG. 9 to advance the upper connector housings 20 and the cover 40 into the space 11 to prevent deformation of the terminal locking lance, as shown in FIG. 9, FIG. 9B, FIG. 10B, FIG. 11B, FIG. 12B and FIGS. 16 through 18. As the upper connector housings 20, lower connector housing 30 and the covers 40 are locked to each other, the united connector 10 is brought into the second engagement state (FIG. 9A→FIG. 9B, FIG. 10A→FIG. 10B, FIG. 11A→FIG. 11B, FIG. 12A→FIG. 12B). The united connector thus holds the pressure contact terminal 50, crimp terminal 52 and the electric wires 51 connected to the terminals 50, 52.

As shown in FIG. 10 and FIGS. 13 through 18, on the lateral ends of the cover 40 of the united connector 10 are arranged a first cover protrusion for first engagement 41, a second cover protrusion for second engagement 42, and a notch hole 43.

On the lateral ends of the upper connector housings 20 are arranged a first upper housing protrusion 21 for first engagement that is projected from the notch hole 43 in the cover and a second upper housing protrusion 22 for second engagement.

Further, on the lateral ends of the lower connector housing 30 are arranged a first lower housing recessed part 31 for locking the first cover protrusion 41 in first engagement and locking the second cover protrusion 42 in second engagement and a second lower housing recessed part 32 for locking the first cover protrusion 41 and the second upper housing protrusion 22 in second engagement.

As shown in FIGS. 10A, 14 and 15, the first cover protrusion 41 of the cover 40 is locked to the first lower housing recessed part 31 and the first upper housing protrusion 21 of the upper connector housing 20 projects from the notch hole in the cover 40. This reliably holds the connector housings 20, 30 and the covers 40 in the first engagement state in the first engagement state of the united connector 10.

As shown in FIG. 10B and FIGS. 14 and 15, the second cover protrusion 42 of the cover 40 is locked to the first lower housing recessed part 31 of the lower housing 30, and the first cover protrusion 41 of the cover 40 and the second protrusion 22 of the upper housing are locked to the second recessed part 32 of the lower connector housing 30. This reliably holds the connector housings 20, 30 and the cover 40 in second engagement state.

In the primary and second engagement states, a situation is avoided where only part of a connector housing or cover is in the second engagement state and the locked part is deformed in an intermediate state between the first engagement state and second engagement state. This allows easy visual check that is based on the external appearance of the united connector 10. In other words, which of the first engagement state shown in FIGS. 5 through 7 and FIG. 10A and the second engagement state shown in FIG. 8 and FIG. 10A the united connector 10 is in is readily identified via visual check.

As shown in FIGS. 1, 11, 21 and 22, the cover 40 includes a central part 44 having a lock arm 44*a* and a flexible displacement part 46 having flexibility arranged between the central part and a cover arranged on each of both sides of the central part 44. The flexible displacement part 46 absorbs, by way of deformation caused by a state change from the first engagement state shown in FIG. 11A to the second engagement state shown in FIG. 11B, the difference in the displacement amount between the central part 44 and each cover part 45 in displacement from the first engagement state to the second engagement state. This provides the same clearance dimension between the cover and the connector housing and elsewhere, thereby preventing the clearance dimension at the center part from becoming greater than elsewhere. This provides a holding force on a terminal in the terminal insertion work or first engagement.

Referring to FIG. 12, on the bottom surface of the cover 40 are arranged a first cover protruding part 47 in a position corresponding to the rear end of the connection part 52*a* of a crimp terminal 52 inserted into the cavity 20*a* of the upper connector housing 20 and a second cover protruding part 48 in a position corresponding to the rear of the caulking part 52*b* of the crimp terminal 52.

On the bottom surfaces of the upper connector housings 20 are arranged a first upper housing protruding part 23 in a position corresponding to the rear end of the connection part 50*a* of a pressure contact terminal 50 inserted into the cavity 30*a* of the lower connector housing 30 and a second upper housing protruding part 24 in a position corresponding to the rear of the pressure contact blade 50*b* of the pressure contact terminal 50.

In the first engagement state, the second upper housing protruding part 24 presses an electric wire 51 at the rear end of the pressure contact blade 50*b* of the pressure contact terminal 50 downward in FIG. 12 to cause the wire to bend. The first upper housing protruding part 23 presses an electric wire 51 ahead of the pressure contact blade 50*b* downward in FIG. 12 to cause the wire to bend. This reduces the load of the pressure contact terminal 50 on the connection part 50*a* without applying an external force transmitted via the electric wire 51 directly to the pressure contact terminal 50 (refer to the illustration in the ellipse shown in FIG. 12*b*).

The cover 40 and the upper connector housings 20 are displaced in accordance with the second engagement process (state shown in FIG. 12A→state shown in FIG. 12B). Thus the second cover protruding part 48 presses the electric wire 51 connected to the crimp terminal 52. This secures the electric wire 51 to each connector housing 20, 30 and prevents a load caused by an external force from being directly applied to the connection part between the terminal 50, 52 and the electric wire 51.

In the above embodiment, in the first engagement state of FIG. 23A, there is a space 11 (refer to the illustration in the ellipse shown in FIG. 23*a*) for inserting a pressure contact terminal between the connector housings 20 and 30 thus allowing the lance 33 to be displaced.

In the second engagement state shown in FIG. 23B, no space is provided between the connector housings 20 and 30 so that the lance cannot be displaced and disengagement will not take place due to deformation of the lance 33 (lance 33 cannot be unlocked). As a result, it is possible to insert an inspection pin from a lance hole (refer to the illustration in the ellipse shown in FIG. 23*b*) in the continuity test. This downsizes the united connector 10.

In case the united connector 10 does not use pressure contact connection, the pressure contact terminal 50 (refer to FIG. 2) is not inserted into the connector housing 20, 30. The connector housings 20, 30 and the covers 40 are placed in the first engagement state.

A method for assembling the united connector 10 will be described referring to FIGS. 25 and 26.

First engagement state of the connector housings 20, 30 and the covers 40 uses a spacer jig 60 where a plurality of spacers 61 projects in predetermined intervals. As shown in FIGS. 25 and 26, with the spacers 61 of the spacer jig 60 inserted into the spaces 11 for inserting a crimp terminal formed between the connector housings 20, 30 and between the connector housings 20 and the covers 40 as a group from the front of the connector housings 20, 30, the connector housings 20, 30 and the covers 40 are pressed in vertical direction in FIG. 26 to perform first engagement.

With the insertion of the spacers 61 of the spacer jig 60, the spaces 11 for inserting a crimp terminal are readily and reliably provided. This readily and reliably performs first engagement of the connector housings 20, 30 and the covers 40 with favorable workability.

According to the above embodiment, in the first engagement state where pressure contact terminals 50 are inserted into the cavities 20*a*, 30*a* of the upper connector housings 20 and the lower connector housing 30 that have been layered and an electric wire 51 is connected in pressure contact to the pressure contact terminal 50, and the united connector is covered with covers 40 so as to integrate the connector housings 20, 30 and the covers 40, a space 11 for inserting a crimp terminal is formed between the connector housings 20, 30 and between the upper connector housings 20 and the cover 40 (refer to FIGS. 5 through 7, FIG. 9A, FIG. 10A, FIG. 11A, FIG. 12A, FIGS. 13 through 15).

In the united connector 10, after the crimp terminal 52 is inserted into the space 11 for inserting a crimp terminal, the upper connector housings 20 and the cover 40 are advanced into the space 11 by a press in vertical direction in FIG. 9 so as to lock the connector housings 20, 30 and the covers 40 in the second engagement state (refer to FIGS. 8, 9B, 10B, 11B, 12B and FIGS. 16 through 18).

It is thus possible to insert the crimp terminal 52 after first engagement of the connector housings 20, 30 and the covers 40 in order to improve workability of terminal insertion in the post-processing. When the connector components are stored before they are united, the components may be brought into the primary lock state so as to avoid an increase in the number of components in storage. In the terminal insertion work in the post-processing, there is no need to disengage the united connector housings 20, 30 and the covers 40 and re-unite the components once the terminal insertion is complete. This reduces the man-hours. Moreover, a spacer component may be done without.

In the first engagement state of the connector housings 20, 30 and the covers 40, it is possible to protect the upper area of the pressure contact part between the pressure contact terminal 50 and the electric wire 51. This prevents a load caused an external force from being directly applied to the pressure contact part, thereby doing without a protecting component such as a rod clamp and reducing the number of necessary components.

By bending the electric wire 51 connected to the pressure contact terminal 50 and holding the wire in the first engagement of the connector housings 20, 30 and the covers 40, it is possible to prevent possible backward drop-off of a terminal or an electric wire and reduce a load on the connection part of the pressure contact terminal.

The first cover protrusion 41 of the cover 40, the first upper housing protrusion 21 of each of the upper connector housings 20 and the first lower housing recessed part 31 of the lower connector housing 30 are used to keep the first engagement state of the connector housings 20, 30 and the covers 40. The second cover protrusion 42 of the cover 40, the second upper housing protrusion 22 of each of the upper connector housings 20 and the second lower housing recessed part 32 of the lower connector housing 30 are used to keep the second engagement state of the connector housings 20, 30 and the covers 40.

It is thus possible to readily and reliably hold the connector housings 20, 30 and the covers 40 in the first engagement state or second engagement state. It is also possible to visually check each locking state.

It is possible to absorb, by way of deformation caused by a state change from the state of the flexible displacement part 46 of the cover shown in FIG. 11A to the state of the same shown in FIG. 11B, the difference in the displacement amount between the central part 44 of the cover 40 and each cover part 45 in displacement from the first engagement state to the second engagement state of the united connector 10. It is thus possible to reduce the profile of the center of the connector thereby reserving a locking space, as well as reduce the number of necessary components and simplify the structure of a connector union jig.

A first cover protruding part 47 is arranged on the bottom surface of the cover 40 in a position corresponding to the rear end of the connection part 52*a* of a crimp terminal 52 inserted into the cavity 20*a* of each of the upper connector housings 20. A second cover protruding part 48 is arranged in a position corresponding to the rear of the caulking part 52*b* of the crimp terminal 52 (refer to FIG. 12). First upper housing protruding part 23 are arranged on the bottom surfaces of the upper connector housings 20 in a position corresponding to the rear end of the connection part 50*a* of a pressure contact terminal 50 inserted into the cavity 30*a* of the lower connector housing 30. Second upper housing protruding parts 24 are arranged in a position corresponding to the rear of the pressure contact blade 50*b* of the pressure contact terminal 50.

Further, in the first engagement state, the second upper housing protruding part 24 presses an electric wire 51 at the rear end of the pressure contact blade 50*b* of the pressure contact terminal 50 downward in FIG. 12 to cause the wire to bend. The first upper housing protruding part 23 presses an electric wire 51 ahead of the pressure contact blade 50*b* downward in FIG. 12 to cause the wire to bend. This reduces the load of the pressure contact terminal 50 on the connection part 50*a* without applying an external force transmitted via the electric wire 51 directly to the pressure contact terminal 50 (refer to the illustration in the ellipse shown in FIG. 12*b*).

The cover 40 and the upper connector housings 20 are displaced in accordance with the second engagement process (state shown in FIG. 12A→state shown in FIG. 12B). Thus the second cover protruding part 48 presses the electric wire 51 connected to the crimp terminal 52. This secures the electric wire 51 to each connector housing 20, 30 and prevents a load caused by an external force from being directly applied to the connection part between the terminal 50, 52 and the electric wire 51.

It is thus possible to secure the electric wire 51 to each connector housing 20, 30 thus preventing a load caused by an external force from being directly applied to the connection part between the terminal 50, 52 and the electric wire 51.

The united connector and the method for assembling the united connector is preferably used for a connection part that requires good workability of terminal insertion and a sufficient holding force of a pressure contact terminal, a crimp terminal and an electric wire.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

The present application is based on Japan Patent Application No. 2004-381875 filed on Dec. 28, 2005, the contents of which are incorporated herein for reference.

What is claimed is:

1. A connector comprising:

a first housing;

a second housing arranged on an upper face of the first housing; and a cover engaged to at least one of the first housing and the second housing so as to cover the upper face of the first housing and an upper face of the second housing, wherein the first housing, the second housing and the cover are engaged to each other at a first engagement state and a second engagement state;

wherein a plurality of press contact terminals with wires are inserted into the first housing and the second housing respectively in the first engagement state;

wherein spaces for allowing the insertion of crimp terminals into the first housing and the second housing respectively are formed between the first housing and the second housing and between the cover and the second housing in the first engagement state; and wherein the second housing and the cover are advanced into the spaces in the second engagement state.

2. The connector as set forth in claim 1, wherein a first cover protrusion for first engagement and a second cover protrusion for second engagement are provided on a side end portion of the cover;

wherein a first housing protrusion for the second engagement is provided on a side end portion of the second housing;

wherein a first housing recessed part and a second housing recessed part are provided on a side end portion of the first housing;

wherein the first housing recessed part is engaged to the first cover protrusion in the first engagement state;

wherein the first housing recessed part is engaged to the second cover protrusion in the second engagement state; and wherein the second housing recessed part is engaged to the first cover protrusion and the first housing protrusion in the second engagement state.

3. The connector as set forth in claim 1, wherein the cover includes a central part, cover parts arranged on both sides of the central part, and flexible displacement parts arranged between the central part and each of the cover parts; and wherein the flexible displacement parts absorbs the difference of a displacement amount between the central part and the cover parts by a flexibility of the flexible displacement parts when the connector displaces from the first engagement state to the second engagement state.

4. The connector as set forth in claim 1, wherein a first cover protruding part is provided on a bottom face of the cover, in a position corresponding to a rear of a caulking part of the crimp terminal or a rear of a pressure contact blade of the pressure contact terminal;

wherein a first housing protruding part is provided on a bottom face of the second housing, in a position corresponding to the rear of the caulking part of the crimp terminal or the rear of the pressure contact blade of the pressure contact terminal; and wherein the cover and the second housing are displaced with respect to the first housing when the connector displaces from the first engagement state to the second engagement state so that the first cover protruding part and the first housing protruding part press wires connected to the crimp terminal and the press contact terminal respectively.

5. The connector as set forth in claim 1, wherein a second cover protruding part is provided on a bottom face of the cover, in a position corresponding to a rear of a connecting part of the pressure contact terminal;

wherein a second housing protruding part is provided on a bottom face of the second housing, in a position corresponding to a rear of a pressure contact blade of the pressure contact terminal; and wherein the second cover protruding part and the second housing protruding part press wires at the rear of the pressure contact blade of the press contact terminal in the first engagement state.

6. The connector as set forth in claim 1, wherein a third cover protruding part is provided on the cover, in a position corresponding to rear of the connection part of the crimp terminal or pressure contact terminal inserted into the second housing; and wherein the third housing protruding part is provided on the second housing, in a position corresponding to rear of the connection part of the crimp terminal or pressure contact terminal inserted into the first housing.

7. A method of assembling a connector, comprising of:

providing a first housing, a second housing and a cover;

arranging the second housing on an upper face of the first housing;

engaging the first housing, the second housing and the cover to each other so that the cover covers the upper face of the first housing and an upper face of the second housing in a first engagement state;

inserting a plurality of crimp terminals into the first housing and the second housing respectively in the first engagement state; and displacing the cover and the second housing with respect to the first housing for displacing from the first engagement state to the second engagement state, wherein spaces for allowing the insertion of crimp terminals into the first housing and the second housing respectively are formed between the first housing and the second housing and between the cover and the second housing in the first engagement state; and wherein the second housing and the cover are advanced into the spaces in the second engagement state.

* * * * *